US011114235B2

(12) United States Patent
Arai et al.

(10) Patent No.: US 11,114,235 B2
(45) Date of Patent: Sep. 7, 2021

(54) MAGNETIC COUPLING COIL COMPONENT

(71) Applicant: TAIYO YUDEN CO., LTD., Tokyo (JP)

(72) Inventors: Takayuki Arai, Tokyo (JP); Masanori Nagano, Tokyo (JP); Akihisa Matsuda, Tokyo (JP); Daisuke Yamaguchi, Tokyo (JP); Naoya Terauchi, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 493 days.

(21) Appl. No.: 16/181,491

(22) Filed: Nov. 6, 2018

(65) Prior Publication Data

US 2019/0148060 A1 May 16, 2019

(30) Foreign Application Priority Data

Nov. 15, 2017 (JP) ..... JP2017-219940

(51) Int. Cl.

| | |
|---|---|
| ***H01F 27/28*** | (2006.01) |
| ***H01F 27/34*** | (2006.01) |
| ***H01F 41/04*** | (2006.01) |
| ***H01F 27/29*** | (2006.01) |
| ***H01F 17/00*** | (2006.01) |

(52) U.S. Cl.

CPC ..... *H01F 27/346* (2013.01); *H01F 17/0013* (2013.01); *H01F 17/0033* (2013.01); *H01F 27/28* (2013.01); *H01F 27/2804* (2013.01); *H01F 27/292* (2013.01); *H01F 41/043* (2013.01); *H01F 41/046* (2013.01); *H01F 2017/004* (2013.01); *H01F 2017/0093* (2013.01); *H01F 2027/2809* (2013.01)

(58) Field of Classification Search

CPC .. H01F 27/346; H01F 41/046; H01F 17/0013; H01F 17/0033; H01F 27/2804; H01F 41/043; H01F 27/292; H01F 2017/004; H01F 2017/0093; H01F 2027/2809

See application file for complete search history.

(56) References Cited

U.S. PATENT DOCUMENTS 4,322,698 A * 3/1982 Takahashi ..... H01F 17/0013 29/602.1
2010/0026443 A1* 2/2010 Yan ..... H01F 27/29 336/234

FOREIGN PATENT DOCUMENTS

JP 2016-131208 A 7/2016

* cited by examiner

*Primary Examiner* — Tuyen T Nguyen

(74) *Attorney, Agent, or Firm* — Pillsbury Winthrop Shaw Pittman, LLP

(57) ABSTRACT

A magnetic coupling coil component includes: a main body including a first region, a second region disposed on a top side of the first region, and a third region disposed on a bottom side of the first region; a top-side coil conductor provided in the second region of the main body and wound around a coil axis extending in a top-bottom direction; and a bottom-side coil conductor provided in the third region of the main body and wound around the coil axis. The top-side coil conductor includes a plurality of top-side conductive patterns, and the plurality of top-side conductive patterns include a first top-side conductive pattern which is positioned closest to the first region among the plurality of top-side conductive patterns, and a number of turns of the first top-side conductive pattern is larger than an average of numbers of turns of the plurality of top-side conductive patterns.

15 Claims, 9 Drawing Sheets

MAGNETIC COUPLING COIL COMPONENT

CROSS-REFERENCE TO RELATED APPLICATIONS

This application is based on and claims the benefit of priority from Japanese Patent Application Serial No. 2017-219940 (filed on Nov. 15, 2017), the contents of which are hereby incorporated by reference in their entirety.

TECHNICAL FIELD

The present invention relates to a magnetic coupling coil component.

BACKGROUND

A typical magnetic coupling coil component includes a pair of coil conductors magnetically coupled to each other. Examples of representative magnetic coupling coil element include a common mode choke coil, a transformer, and a coupled inductor. Typically, in a magnetic coupling coil component, it is preferable that the coupling between the pair of coil conductors is enhanced.

A conventional magnetic coupling coil component produced by a lamination process is disclosed in Japanese Patent Application Publication No. 2016-131208 ("the '208 Publication"). This magnetic coupling coil component includes a pair of coil units embedded in an insulator body made of an insulating material The pair of coil units are joined together such that the winding axes of the coil conductors of the coil units are substantially aligned with each other and the coil units are tightly contacted with each other, thereby enhancing the coupling between the pair of coil conductors.

In the conventional magnetic coupling coil component, there is a magnetic flux passing through a region in the insulator body between the pair of coil conductors. The magnetic flux passing through this region is a leakage flux that does not contribute to the coupling between the pair of coil conductors. Such leakage flux may degrade the coupling between the pair of coil conductors.

In a magnetic coupling coil component, conductive patterns are formed on each of a plurality of insulating films stacked together, and these conductive patterns are electrically connected with each other via vias to form the coil conductors. Of the plurality of insulating films, those at opposite ends in the lamination direction have a conductive pattern formed thereon that is connected to an external electrode via a lead-out conductor. Therefore, the conductive patterns formed on the insulating films at opposite ends in the lamination direction are wound for a smaller number of turns than other conductive patterns. For example, in the '208 Publication, the conductive patterns at opposite ends in the lamination direction (denoted by the signs 11*c*1 and 11*c*6 in FIG. 3 of the '208 Publication) are wound for about a three-fifth turn around the coil axis, whereas the other conductive patterns between them (denoted by the signs 11*c*2 to 11*c*5 in the same figure) are wound for about a seven-eighth turn.

The conductive pattern at one end in the lamination direction is adjacent to the region between the coils that is passed through by the leakage flux. When the conductive pattern adjacent to the region between the coils is wound for a smaller number of turns, the magnetic resistance of the region between the coils is reduced, resulting in more leakage flux. Therefore, in a magnetic coupling coil component, when the conductive patterns adjacent to the region between the two coil conductors are wound for a small number of turns, the coupling between the two coil conductors is degraded.

SUMMARY

One object of the present invention is to provide a magnetic coupling coil component having an improved coupling between the coil conductors. Other objects of the present invention will be made apparent through description in the entire specification.

A magnetic coupling coil component according to one embodiment of the present invention comprises: a main body including a first region, a second region disposed on a top side of the first region, and a third region disposed on a bottom side of the first region; a top-side coil conductor provided in the second region of the main body and wound around a coil axis extending in a top-bottom direction; and a bottom-side coil conductor provided in the third region of the main body and wound around the coil axis. In the embodiment, the top-side coil conductor includes a plurality of top-side conductive patterns, and the plurality of top-side conductive patterns include a first top-side conductive pattern which is positioned closest to the first region among the plurality of top-side conductive patterns, and a number of turns of the first top-side conductive pattern is larger than an average of numbers of turns of the plurality of top-side conductive patterns. In one embodiment of the present invention, the plurality of top-side conductive patterns include a second top-side conductive pattern which is more distant from the first region than the first top-side conductive pattern, and the number of turns of the first top-side conductive pattern is larger than that of the second top-side conductive pattern. In one embodiment of the present invention, the plurality of top-side conductive patterns include a third top-side conductive pattern which is more distant from the first region than the second top-side conductive pattern, and the number of turns of the second top-side conductive pattern is larger than that of the third top-side conductive pattern. In one embodiment of the present invention, the first top-side conductive pattern include a circling portion and a lead-out conductor, the circling portion extending in a circumferential direction around the coil axis, the lead-out conductor connecting between one end of the circling portion and an external electrode.

According to the above embodiments, the plurality of top-side conductive patterns include a first top-side conductive pattern which is positioned closest to the first region between the top-side coil conductor and the bottom-side coil conductor among the plurality of top-side conductive patterns, and the first top-side conductive pattern increases the magnetic resistance in a region between the top-side coil conductor and the bottom-side coil conductor. As a result, the leakage flux passing between the top-side coil conductor and the bottom-side coil conductor can be suppressed more effectively.

In one embodiment of the present invention, the plurality of top-side conductive patterns include a second top-side conductive pattern which is more distant from the first region than the first top-side conductive pattern, and the main body includes a first top-side open region and a second top-side open region, the first top-side open region extending between opposite ends of the first top-side conductive pattern, the second top-side open region extending between opposite ends of the second top-side conductive pattern, and the second top-side open region does not overlap the first top-side open region as viewed from the direction of the coil axis.

According to this embodiment, it is possible to prevent the reduction of the magnetic resistance due to overlap of the first top-side open region and the second top-side open region. As a result, the leakage flux passing between the top-side coil conductor and the bottom-side coil conductor can be suppressed more effectively.

In the embodiment of the present invention, the bottom-side coil conductor includes a plurality of bottom-side conductive patterns, and the plurality of bottom-side conductive patterns include a first bottom-side conductive pattern which is positioned closest to the first region among the plurality of bottom-side conductive patterns, and a number of turns of the first bottom-side conductive pattern is larger than an average of numbers of turns of the plurality of bottom-side conductive patterns. In one embodiment of the present invention, the plurality of bottom-side conductive patterns include a second bottom-side conductive pattern which is more distant from the first region than the first bottom-side conductive pattern, and the number of turns of the first bottom-side conductive pattern is larger than that of the second bottom-side conductive pattern. In one embodiment of the present invention, the plurality of bottom-side conductive patterns include a third bottom-side conductive pattern which is more distant from the first region than the second bottom-side conductive pattern, and the number of turns of the second bottom-side conductive pattern is larger than that of the third bottom-side conductive pattern. In one embodiment of the present invention, the first bottom-side conductive pattern include a circling portion and a lead-out conductor, the circling portion extending in a circumferential direction around the coil axis, the lead-out conductor connecting between one end of the circling portion and an external electrode.

According to the above embodiments, the plurality of bottom-side conductive patterns include a first bottom-side conductive pattern which is positioned closest to the first region between the top-side coil conductor and the bottom-side coil conductor among the plurality of bottom-side conductive patterns, and the first bottom-side conductive pattern increases the magnetic resistance in a region between the top-side coil conductor and the bottom-side coil conductor. As a result, the leakage flux passing between the top-side coil conductor and the bottom-side coil conductor can be suppressed more effectively.

In one embodiment of the present invention, the plurality of bottom-side conductive patterns include a second bottom-side conductive pattern which is more distant from the first region than the first bottom-side conductive pattern, and the main body includes a first bottom-side open region and a second bottom-side open region, the first bottom-side open region extending between opposite ends of the first bottom-side conductive pattern, the second bottom-side open region extending between opposite ends of the second bottom-side conductive pattern, and the second bottom-side open region does not overlap the first bottom-side open region as viewed from the direction of the coil axis.

According to this embodiment, it is possible to prevent the reduction of the magnetic resistance due to overlap of the first bottom-side open region and the second bottom-side open region. As a result, the leakage flux passing between the top-side coil conductor and the bottom-side coil conductor can be suppressed more effectively.

Advantages

According to one embodiment of the present invention, a magnetic coupling coil component having an improved coupling coefficient can be obtained.

DESCRIPTION OF THE EMBODIMENTS

Various embodiments of the invention will be described hereinafter with reference to the drawings. Elements common to a plurality of drawings are denoted by the same reference signs throughout the plurality of drawings. It should be noted that the drawings do not necessarily appear to an accurate scale, for convenience of description.

Figure 1:
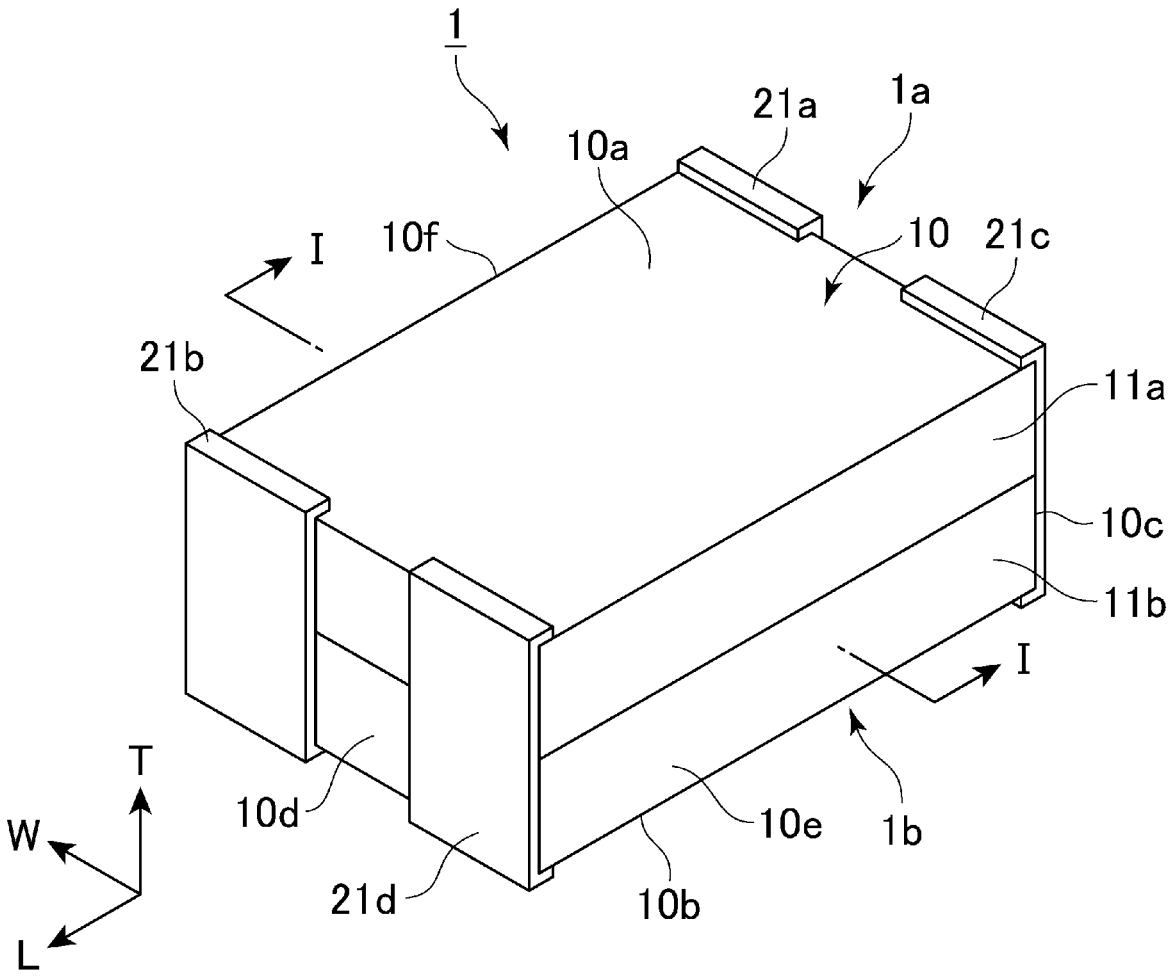
FIG. 1 is a perspective view of a coil component according to one embodiment of the present invention.
Figure 2:
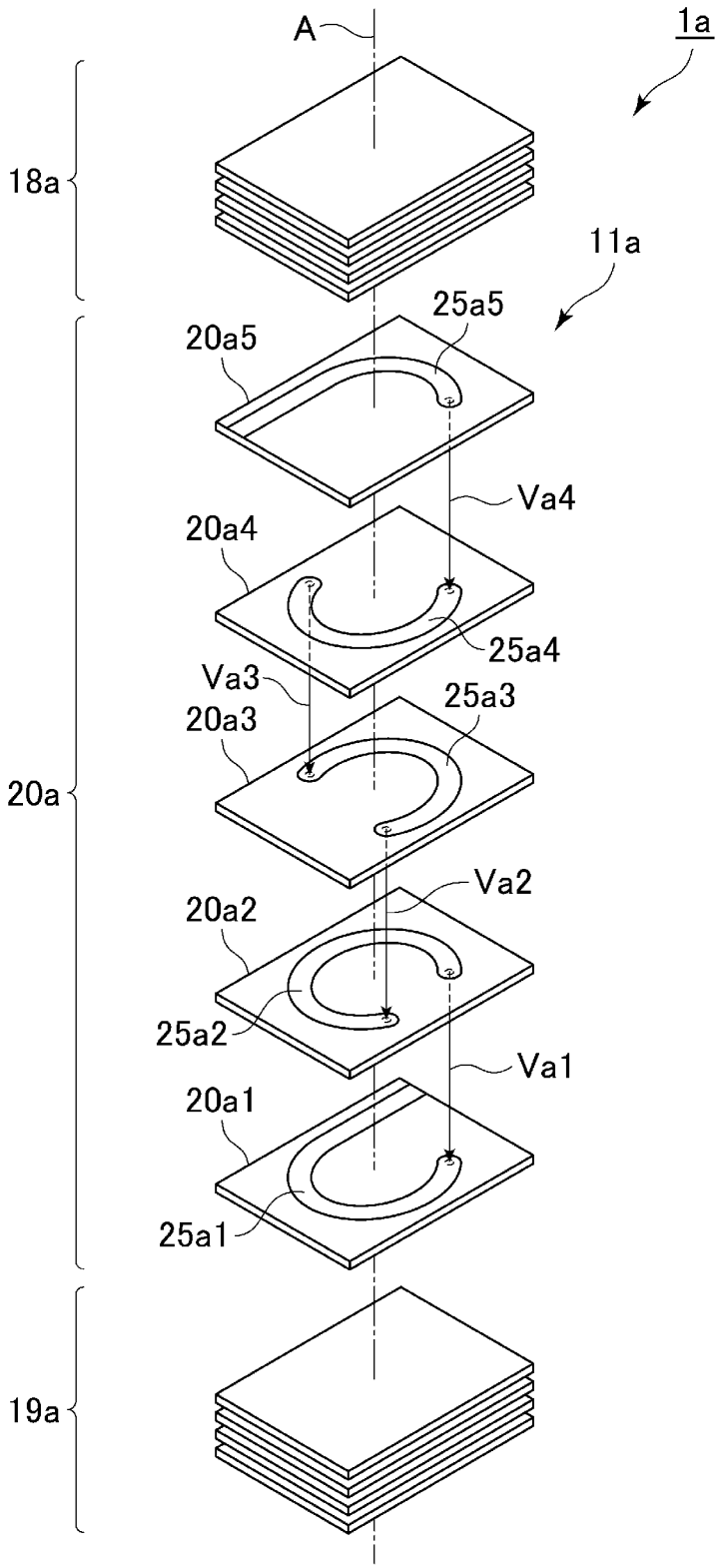
FIG. 2 is an exploded perspective view of one of two coil units included in the coil component of FIG. 1.
Figure 3:
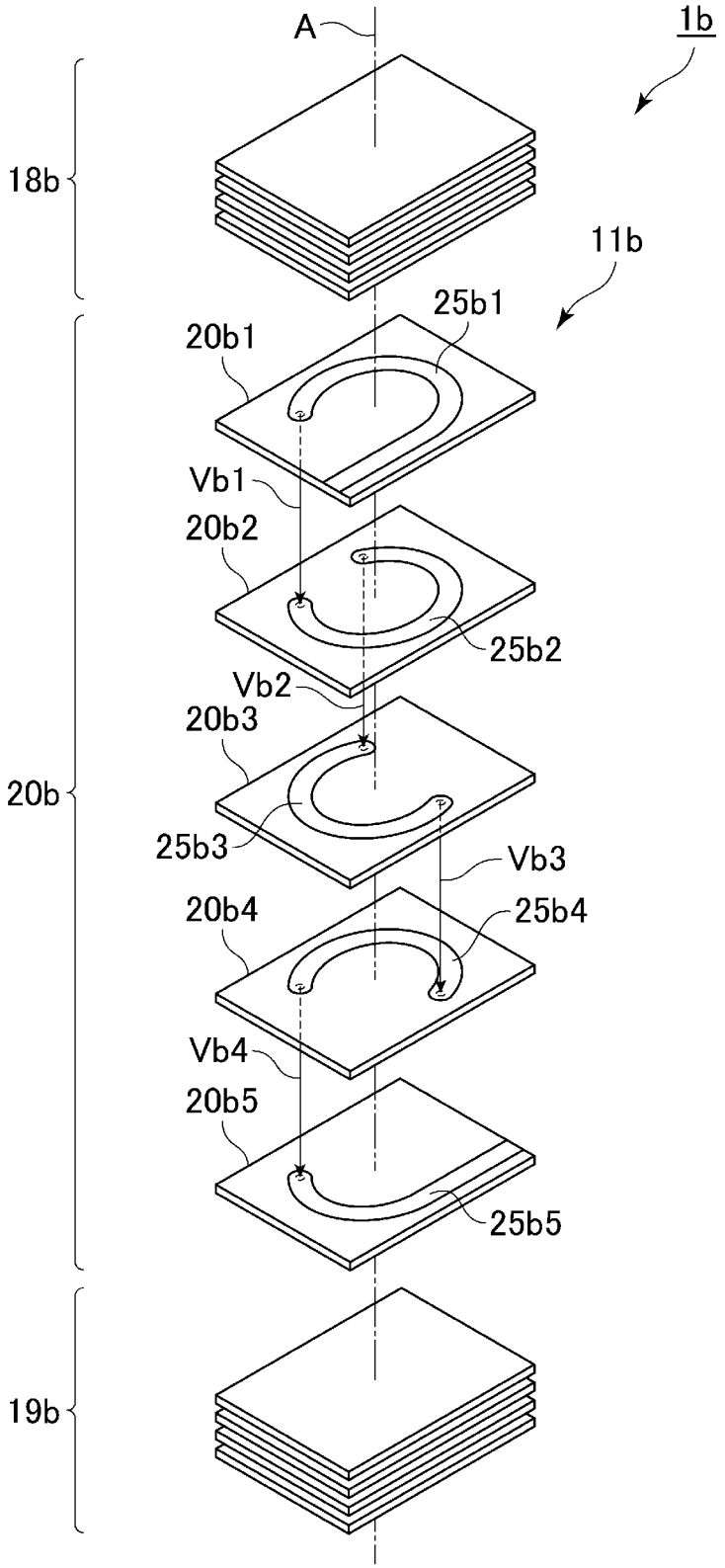
FIG. 3 is an exploded perspective view of the other of the two coil units included in the coil component of FIG. 1.
Figure 4:
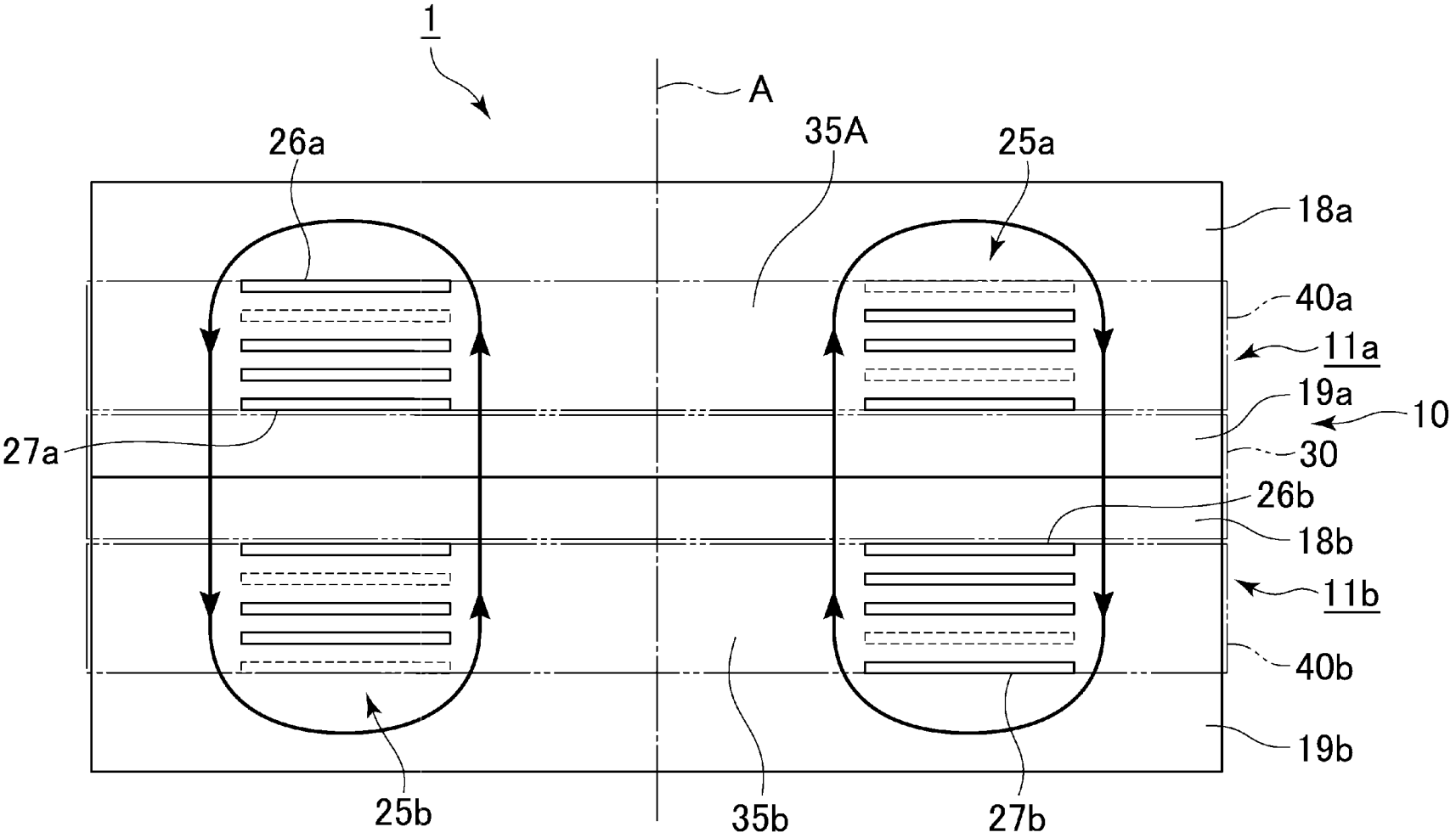
FIG. 4 schematically shows a cross section of the coil component of FIG. 1 cut along the line I-I.

A coil component 1 according to one embodiment of the present invention will be hereinafter described with reference to FIGS. 1 to 3. FIG. 1 is a perspective view of a coil component 1 according to one embodiment of the present invention, FIG. 2 is an exploded perspective view of a coil unit la included in the coil component 1 of FIG. 1, FIG. 3 is an exploded perspective view of a coil unit lb included in the coil component 1 of FIG. 1, and FIG. 4 schematically shows a cross section of the coil component 1 of FIG. 1 cut along the line I-I. In FIGS. 2 to 4, the external electrodes are omitted for convenience of description.

These drawings show, as one example of the coil component 1, a common mode choke coil for eliminating common mode noise from a differential transmission circuit that transmits a differential signal. A common mode choke coil is one example of a magnetic coupling coil component to which the present invention is applicable. As will be described later, a common mode choke coil is produced by a lamination process, a thin film process, or other known methods. The present invention can also be applied to a transformer, a coupled inductor, and other various coil components, in addition to a common mode choke coil.

As shown, the coil component 1 according to one embodiment of the present invention includes the top-side coil unit la and the bottom-side coil unit 1*b*.

The top-side coil unit 1*a* includes a top-side body 11*a* made of an insulating material having an excellent insulating quality, a top-side coil conductor 25*a* embedded in the top-side body 11*a*, an external electrode 21*a* electrically connected to one end of the top-side coil conductor 25*a*, and an external electrode 21*b* electrically connected to the other end of the top-side coil conductor 25*a*. The top-side body 11*a* has a rectangular parallelepiped shape.

The bottom-side coil unit 1*b* is configured in the same manner as the top-side coil unit 1*a*. More specifically, the bottom-side coil unit 1*b* includes a bottom-side body 11*b* made of an insulating material, a bottom-side coil conductor 25*b* embedded in the bottom-side body 11*b*, an external electrode 21*c* electrically connected to one end of the bottom-side coil conductor 25*b*, and an external electrode 21*d* electrically connected to the other end of the bottom-side coil conductor 25*b*. The bottom-side body 11*b* has a rectangular parallelepiped shape.

The top-side coil conductor 25*a* is wound around the coil axis A in the top-side body 11*a*. The bottom-side coil conductor 25*a* is wound around the coil axis A in the bottom-side body 11*b*. The coil axis A may extend in parallel to the axis T in FIG. 1. The top-bottom direction of the coil component 1 may herein refer to the direction along the coil axis A. When the coil axis A extends in parallel to the axis T, the direction from the negative side toward the positive side in the direction of the axis T may be referred to as the upward direction, and the direction from the positive side toward the negative side in the direction of the axis T may be referred to as the downward direction. This rule is herein followed as far as possible, that is, the direction from the negative side toward the positive side in the direction of the axis T is referred to as the upward direction, and the direction from the positive side toward the negative side in the direction of the axis T may be referred to as the downward direction. For example, of the pair of coil units included in the coil component 1, the coil unit on the positive side in the direction of the axis T is referred to as the top-side coil unit 1*a*, and the coil unit on the negative side in the direction of the axis T is referred to as the bottom-side coil unit 1*b*, in accordance with the above rule. It is also possible that the coil axis A extends along a direction perpendicular to the axis T, for example, the direction of the axis L. In the case, the direction along the coil axis A may still be referred to as the top-bottom direction of the coil component 1. Accordingly, the top-bottom direction of the coil component 1 may be parallel to the axis T as in the embodiment shown or may be perpendicular to the axis T in other embodiments.

In this specification, the "length" direction, the "width" direction, and the "thickness" direction of the coil component 1 refer to the direction "L", the direction "W", and the direction "T" in FIG. 1, respectively.

The bottom surface of the top-side body 11*a* is joined to the top surface of the bottom-side body 11*b*. The top-side body 11*a* and the bottom-side body 11*b* are joined to each other to constitute a main body 10. Accordingly, the main body 10 includes the top-side body 11*a* and the bottom-side body 11*b* joined to the top-side body 11*a*.

The main body 10 has a first principal surface 10*a*, a second principal surface 10*b*, a first end surface 10*c*, a second end surface 10*d*, a first side surface 10*e*, and a second side surface 10*f*. The outer surface of the main body 10 is defined by these six surfaces. The first principal surface 10*a* and the second principal surface 10*b* are opposed to each other, the first end surface 10*c* and the second end surface 10*d* are opposed to each other, and the first side surface 10*e* and the second side surface 10*f* are opposed to each other. In FIG. 1, the first principal surface 10*a* lies on the top side of the main body 10, and therefore, the first principal surface 10*a* may be herein referred to as "the top surface". Similarly, the second principal surface 10*b* may be referred to as "the bottom surface." The coil component 1 is disposed such that the second principal surface 10*b* faces a circuit board (not shown), and therefore, the second principal surface 10*b* may be herein referred to as "the mounting surface."

The external electrode 21*a* and the external electrode 21*c* are provided on the first end surface 10*c* of the main body 10. The external electrode 21*b* and the external electrode 21*d* are provided on the second end surface 10*d* of the main body 10. As shown, each of these external electrodes extends onto the top surface and the bottom surface of the main body 10. The shape and the arrangement of the external electrodes are not limited to those shown in the drawing. For example, it is also possible that the external electrodes 21*a* to 21*d* are all provided on the bottom surface 10*b* of the main body 10. In this case, the top-side coil conductor 25*a* and the bottom-side coil conductor 25*b* are connected, via the vias, to the external electrodes 21*a* to 21*d* provided on the bottom surface 10*b* of the main body 10.

With reference to FIG. 2, a further description will be given of the top-side body 11*a* and the top-side coil conductor 25*a* provided in the top-side body 11*a*. As shown, the top-side body 11*a* includes a top-side coil layer 20*a*, a top-side first cover layer 18*a* provided on the top surface of the top-side coil layer 20*a*, and a top-side second cover layer 19*a* provided on the bottom surface of the top-side cold layer 20*a*.

The top-side coil layer 20*a* includes insulating films 20*a*1 to 20*a*5 stacked together. The top-side body 11*a* includes the top-side second cover layer 19*a*, the insulating film 20*a*1, the insulating film 20*a*2, the insulating film 20*a*3, the insulating film 20*a*4, the insulating film 20*a*5, and the top-side first cover layer 18*a* that are stacked in this order from the negative side to the positive side in the direction of the axis T. Depending on the production method of the coil unit la, the boundary between the top-side coil layer 20*a* and the top-side first cover layer 18*a*, the boundary between the top-side coil layer 20*a* and the top-side second cover layer 19*a*, and the boundaries between the insulating films 20*a*1 to 20*a*5 may not be clear.

The insulating films 20*a*1 to 20*a*5 are made of an insulating material having an excellent insulating quality. The material used for the insulating films 20*a*1 to 20*a*5 is either magnetic or non-magnetic. The magnetic materials used for the insulating films 20*a*1 to 20*a*5 include ferrite materials, soft magnetic alloy materials, composite materials including a large number of filler particles dispersed in a resin, or any other known magnetic materials. The non-magnetic materials used for the insulating films 20*a*1 to 20*a*5 include inorganic material particles such as $SiO_2$ and $Al_2O_3$ (glass-based particles), composite materials including inorganic material particles such as $SiO_2$ and $Al_2O_3$ (glass-based particles) dispersed in a resin, resins, or glass materials.

Examples of the ferrite materials used for the insulating films 20*a*1 to 20*a*5 include a Ni—Zn-based ferrite, a Ni—Zn—Cu-based ferrite, a Mn—Zn-based ferrite, or any other ferrite materials.

Examples of the soft magnetic alloy materials used for the insulating films 20*a*1 to 20*a*5 include a Fe—Si-based alloy, a Fe—Ni-based alloy, a Fe—Co-based alloy, a Fe—Cr—

Si-based alloy, a Fe—Si—Al-based alloy, a Fe—Si—B—Cr-based alloy, or any other soft magnetic alloy materials.

When the insulating films 20*a*1 to 20*a*7 are made of a composite material including a large number of filler particles dispersed in a resin, the resin may be a thermosetting resin having an excellent insulating quality, examples of which include an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, or a polybenzoxazole (PBO) resin. The filler particles may be particles of a ferrite material, metal magnetic particles, particles of an inorganic material such as $SiO_2$ or $Al_2O_3$, glass-based particles, or any other known filler particles. Particles of a ferrite material applicable to the present invention are, for example, particles of Ni—Zn ferrite or particles of Ni—Zn—Cu ferrite. Metal magnetic particles applicable to the present invention are, for example, particles of (1) metals such as Fe or Ni, (2) alloys such as Fe—Si—Cr, Fe—Si—Al, or Fe—Ni, (3) amorphous materials such as Fe—Si—Cr—B—C or Fe—Si—B—Cr, or a mixture thereof.

On the top surfaces of the insulating films 20*a*1 to 20*a*5, there are provided top-side conductive patterns 25*a*1 to 25*a*5, respectively. The top-side conductive patterns 25*a*1 to 25*a*5 are formed by applying a conductive paste made of a metal or alloy having an excellent electrical conductivity by screen printing. The conductive paste may be made of Ag, Pct Cu, Al, or alloys thereof. The conductive patterns 25*a*1 to 25*a*5 may be formed by other methods using other materials. For example, the conductive patterns 25*a*1 to 25*a*5 may be formed by sputtering, ink-jetting, or other known methods.

The insulating films 20*a*2 to 20*a*5 are provided with top-side vias Va1 to Va4, respectively, at predetermined positions therein. The top-side vias Va1 to Va4 are formed by drilling through-holes at predetermined positions in the insulating films 20*a*2 to 20*a*5 so as to extend through the insulating films 20*a*2 to 20*a*5 in the direction of the axis T and filling a conductive paste into the through-holes.

Each of the top-side conductive patterns 25*a*1 to 25*a*5 is electrically connected to adjacent ones via the top-side vias Va1 to Va4. The top-side conductive patterns 25*a*1 to 25*a*5 connected in this manner constitute the top-side coil conductor 25*a* having a spiral shape. In other words, the top-side coil conductor 25*a* includes the top-side conductive patterns 25*a*1 to 25*a*5 and the top-side vias Va1 to Va4.

The end of the top-side conductive pattern 25*a*1 opposite to the other end connected to the top-side via Va1 is connected to the external electrode 21*a*. The end of the top-side conductive pattern 25*a*5 opposite to the other end connected to the top-side via Va4 is connected to the external electrode 21*b*.

The top-side coil conductor 25*a* has a coil surface 26*a* and a coil surface 27*a*, the coil surface 26*a* constituting one end of the top-side coil conductor 25*a* in the direction of the axis T, the coil surface 27*a* constituting the other end of the top-side coil conductor 25*a* in the direction of the axis T.

The top-side first cover layer 18*a* and the top-side second cover layer 19*a* may include a plurality of insulating films stacked together. As with the insulating films 20*a*1 to 20*a*5, the insulating films constituting the top-side first cover layer 18*a* are made of various magnetic materials or non-magnetic materials. The magnetic materials used for the insulating films constituting the top-side first cover layer 18*a* and the top-side second cover layer 19*a* include ferrite materials, composite materials including a large number of filler particles dispersed in a resin, or any other known magnetic materials. The non-magnetic materials used for the insulating films constituting the top-side first cover layer 18*a* and the top-side second cover layer 19*a* include inorganic material particles such as $SiO_2$ and $Al_2O_3$ (glass-based particles), composite materials including inorganic material particles such as $SiO_2$ and $Al_2O_3$ (glass-based particles) dispersed in a resin, resins, or glass materials.

The top-side first cover layer 18*a* is disposed on the top surface of the top-side coil layer 20*a* so as to be opposed to the coil surface 26*a* of the top-side coil conductor 25*a*. The top-side second cover layer 19*a* is disposed on the bottom surface of the top-side coil layer 20*a* so as to be opposed to the coil surface 27*a* of the top-side coil conductor 25*a*.

With reference to FIG. 3, a further description will be given of the bottom-side body 11*b* and the bottom-side coil conductor 25*b* provided in the bottom-side body 11*b*. As shown, the bottom-side body 11*b* includes a bottom-side coil layer 20*b*, a bottom-side first cover layer 18*b* provided on the top surface of the bottom-side coil layer 20*b*, and a bottom-side second cover layer 19*b* provided on the bottom surface of the bottom-side coil layer 20*b*.

The bottom-side coil layer 20*b* includes insulating films 20*b*1 to 20*b*5 stacked together. The bottom-side body 11*b* includes the bottom-side first cover layer 18*b*, the insulating film 20*b*1, the insulating film 20*b*2, the insulating film 20*b*3, the insulating film 20*b*4, the insulating film 20*b*5, and the bottom-side second cover layer 19*b* that are stacked in this order from the positive side to the negative side in the direction of the axis T. Depending on the production method of the coil unit 1*b*, the boundary between the bottom-side coil layer 20*b* and the bottom-side first cover layer 18*b*, the boundary between the bottom-side coil layer 20*b* and the bottom-side second cover layer 19*b*, and the boundaries between the insulating films 20*b*1 to 20*b*5 may not be clear.

On the top surfaces of the insulating films 20*b*1 to 20*b*5, there are provided bottom-side conductive patterns 25*b*1 to 25*b*5, respectively. The bottom-side conductive patterns 25*b*1 to 25*b*5 may be formed by the same method as the top-side conductive patterns 25*a*1 to 25*a*5.

The insulating films 20*b*1 to 20*b*4 are provided with bottom-side vias Vb1 to Vb4, respectively, at predetermined positions therein. The bottom-side vias Vb1 to Vb4 are formed by drilling through-holes at predetermined positions in the insulating films 20*b*1 to 20*b*4 so as to extend through the insulating films 20*b*1 to 20*b*4 in the direction of the axis T and filling a conductive material into the through-holes.

Each of the bottom-side conductive patterns 25*b*1 to 25*b*5 is electrically connected to adjacent ones via the bottom-side vias Vb1 to Vb4. The bottom-side conductive patterns 25*b*1 to 25*b*5 connected in this manner constitute the bottom-side coil conductor 25*b* having a spiral shape. In other words, the bottom-side coil conductor 25*b* includes the bottom-side conductor patterns 25*b*1 to 25*b*5 and the bottom-side vias Vb1 to Vb4.

The end of the bottom-side conductive pattern 25*b*1 opposite to the other end connected to the bottom-side via Vb1 is connected to the external electrode 21*d*. The end of the bottom-side conductive pattern 25*b*5 opposite to the other end connected to the bottom-side via Vb4 is connected to the external electrode 21*c*.

The bottom-side coil conductor 25*b* has a coil surface 26*b* and a coil surface 27*b*, the coil surface 26*b* constituting one end of the bottom-side coil conductor 25*b* in the direction of the axis T, the coil surface 27*b* constituting the other end of the bottom-side coil conductor 25*b* in the direction of the axis T.

The bottom-side first cover layer 18*b* and the bottom-side second cover layer 19*b* may include a plurality of insulating films stacked together.

The bottom-side first cover layer 18*b* is disposed on the top surface of the bottom-side coil layer 20*b* so as to be opposed to the coil surface 26*b* of the bottom-side coil conductor 25*b*. The bottom-side second cover layer 19*b* is disposed on the bottom surface of the bottom-side coil layer 20*b* so as to be opposed to the coil surface 27*b* of the bottom-side coil conductor 25*b*.

As with the insulating films 20*a*1 to 20*a*5, the insulating films constituting the insulating films 20*b*1 to 20*b*5, the bottom-side first cover layer 18*b*, and the bottom-side second cover layer 19*b* are made of various magnetic materials or non-magnetic materials. The magnetic materials used for the insulating films constituting the insulating films 20*b*1 to 20*b*5, the bottom-side first cover layer 18*b*, and the bottom-side second cover layer 19*b* include ferrite materials, soft magnetic alloy materials, composite materials including a large number of filler particles dispersed in a resin, or any other known magnetic materials. The non-magnetic materials used for these insulating films include inorganic material particles such as $SiO_2$ and $Al_2O_3$ (glass-based particles), composite materials including inorganic material particles such as $SiO_2$ and $Al_2O_3$ (glass-based particles) dispersed in a resin, resins, or glass materials.

It is possible that all of the insulating films 20*a*1 to 20*a*5, the insulating films constituting the top-side first cover layer 18*a*, the insulating films constituting the top-side second cover layer 19*a*, the insulating films 20*b*1 to 20*b*5, the insulating films constituting the bottom-side first cover layer 18*b*, and the insulating films constituting the bottom-side second cover layer 19*b* are made of a ferrite material, all of these insulating films are made of a soft magnetic alloy material, or all of these insulating films are made of a composite material including a large number of filler particles dispersed in a resin. It is possible that a part of the insulating films 20*a*1 to 20*a*5, the insulating films constituting the top-side first cover layer 18*a*, the insulating films constituting the top-side second cover layer 19*a*, the insulating films 20*b*1 to 20*b*5, the insulating films constituting the bottom-side first cover layer 18*b*, and the insulating films constituting the bottom-side second cover layer 19*b* is made of a different material than the other insulating films.

The coil component 1 is fabricated by joining the coil unit 1*a* and the coil unit 1*b* together. The coil component 1 includes the top-side coil conductor 25*a* and the bottom-side coil conductor 25*b*, the top-side coil conductor 25*a* being positioned between the external electrode 21*a* and the external electrode 21*b*, the bottom-side coil conductor 25*b* being positioned between the external electrode 21*c* and the external electrode 21*d*. These two coils are connected to, for example, two signal lines in a differential transmission circuit, respectively. Thus, the coil component 1 can operate as a common mode choke coil The coil component 1 may include a third coil (not shown). The coil component 1 having the third coil additionally includes another coil unit configured in the same manner as the top-side coil unit 1*a*. As with the top-side coil unit 1*a* and the bottom-side coil unit 1*b*, the additional coil unit includes a coil conductor that is connected to additional external electrodes. The coil component including three coils is used as, for example, a common mode choke coil for a differential transmission circuit having three signal lines.

A cross section of the coil component 1 is shown in FIG. 4. FIG. 4 schematically shows a cross section of the coil component of FIG. 1 cut along the line I-I. In FIG. 4, the magnetic flux (the lines of magnetic force) generated from the coil conductor is represented by arrows. In FIG. 4, the external electrodes 21*a* to 21*d* and the boundaries between the individual insulating films are omitted for convenience of description.

As shown, the main body 10 includes a first region 30, a second region 40*a*, and a third region 40*b*. The first region 30 is positioned between the coil surface 27*a* of the top-side coil conductor 25*a* and the coil surface 26*b* of the bottom-side coil conductor 25*b*, the second region 40*a* is positioned between the first region 30 and the top-side first cover layer 18*a*, and the third region 40*b* is positioned between the first region 30 and the bottom-side second cover layer 19*b*.

In one embodiment of the present invention, the first region 30 includes the top-side second cover layer 19*a* and the bottom-side first cover layer 18*b*. The first region 30 may be constituted only by the top-side second cover layer 19*a* and the bottom-side first cover layer 18*b*. The first region 30 may include an additional insulating film or a part thereof, in addition to the top-side second cover layer 19*a* and the bottom-side first cover layer 18*b*. The first region 30 may directly contact with the bottom surface 27*a* of the top-side coil conductor 25*a*, or may indirectly contact with the bottom surface 27*a* of the top-side coil conductor 25*a* via another insulating film. The first region 30 may directly contact with the top surface 26*b* of the bottom-side coil conductor 25*b*, or may indirectly contact with the top surface 26*b* of the bottom-side coil conductor 25*b* via another insulating film.

In one embodiment of the present invention, the second region 40*a* includes the insulating films 20*a*1 to 20*a*5. The second region 40*a* may be constituted only by the insulating films 20*a*1 to 20*a*5. The second region 40*a* may include an additional insulating film made of an insulating material, in addition to the insulating films 20*a*1 to 20*a*5.

In one embodiment of the present invention, the third region 40*b* includes the insulating films 20*b*1 to 20*b*5. The third region 40*b* may be constituted only by the insulating films 20*b*1 to 20*b*5. The third region 40*b* may include an additional insulating film made of an insulating material, in addition to the insulating films 20*b*1 to 20*b*5.

The second region 40*a* may directly contact with the first region 30. The third region 40*b* may directly contact with the first region 30.

The top-side coil conductor 25*a* is provided in the second region 40*a* of the main body 10. In the embodiment shown, the top-side coil conductor 25*a* is disposed such that the coil surface 26*a* is exposed from the second region 40*a* toward the top-side first cover layer 18*a* and the coil surface 27*a* is exposed from the second region 40*a* toward the first region 30.

The bottom-side coil conductor 25*b* is provided in the third region 40*b* of the main body 10. In the embodiment shown, the bottom-side coil conductor 25*b* is disposed such that the coil surface 26*b* is exposed from the third region 40*b* toward the first region 30 and the coil surface 27*b* is exposed from the third region 40*b* toward the bottom-side second cover layer 19*b*.

The bottom-side coil conductor 25*b* is wound around the coil axis A as in the top-side body 11*a*. In this specification, the region of the top-side body 11*a* inside the top-side coil conductor 25*a* may be referred to as the top-side core 35*a*, and the region of the bottom-side body 11*b* inside the bottom-side coil conductor 25*b* may be referred to as the bottom-side core 35*b*.

Next, with reference to FIGS. 5*a* to 5*e* and FIGS. 6*a* to 6*e*, a further description will be given of the top-side coil conductor 25*a* and the bottom-side coil conductor 25*b*. FIGS. 5*a* to 5*e* are plan views showing insulating films 20*a*5 to 20*a*1 and the conductive patterns 25*a*5 to 25*a*1 formed on these insulating films, respectively, and FIGS. 6*a* to 6*e* are plan views showing insulating films 20*b*1 to 20*b*5 and the conductive patterns 25*b*1 to 25*b*5 formed on these insulating films, respectively. In these figures, the external electrodes are omitted for convenience of description.

Figure 5A:
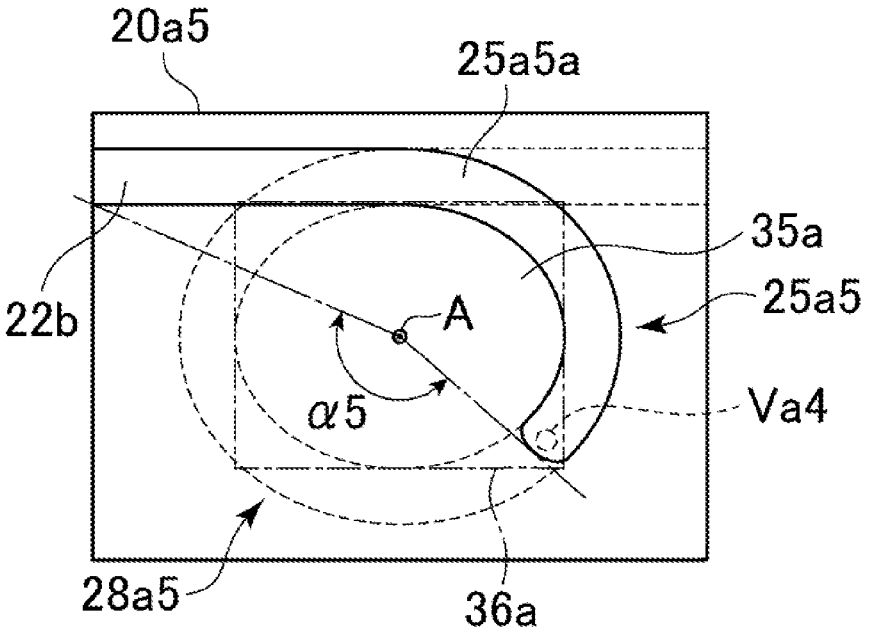
FIG. 5*a* is a plan view showing an insulating film 20*a*5 and a top-side conductive pattern 25*a*5 of FIG. 2.

As shown in FIG. 5*a*, the insulating film 20*a*5 has the conductive pattern 25*a*5 formed thereon. The conductive pattern 25*a*5 includes a circling portion 25*a*5*a* and a lead-out conductor 22*b*. The lead-out conductor 22*b* extends substantially straight from one end of the circling portion 25*a*5*a* to the external electrode 21*b*. The circling portion 25*a*5*a* extends clockwise around the coil axis A from a connection point connecting with the lead-out conductor 22*b* to a connection point connecting with the via Va4.

Figure 5B:
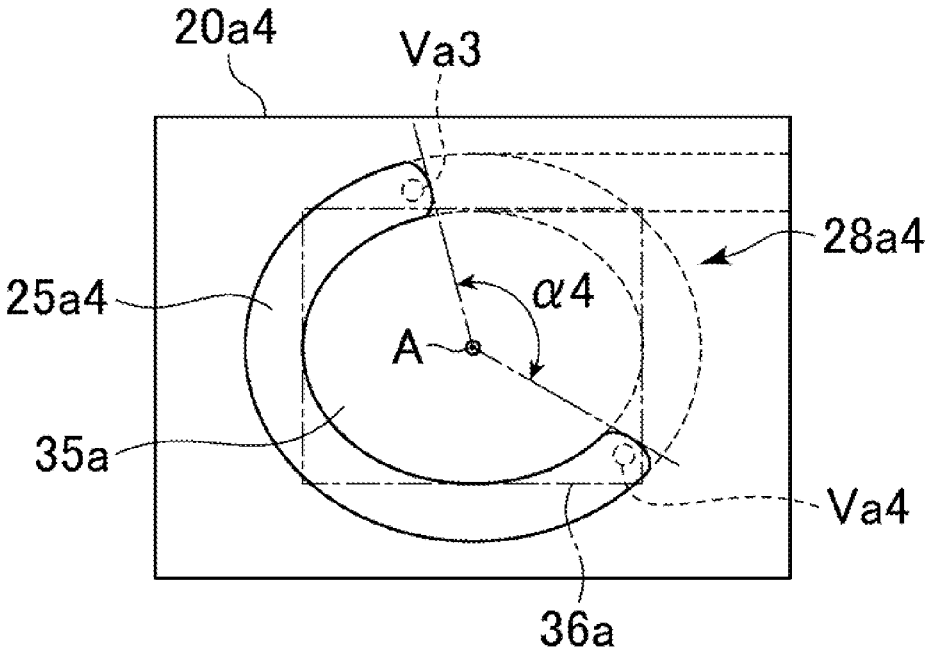
FIG. 5*b* is a plan view showing an insulating film 20*a*4 and a top-side conductive pattern 25*a*4 of FIG. 2.

As shown in FIG. 5*b*, the insulating film 20*a*4 has the conductive pattern 25*a*4 formed thereon. The conductive pattern 25*a*4 is electrically connected to the conductive pattern 25*a*5 via the via Va4. The conductive pattern 25*a*4 extends clockwise around the coil axis A from a connection point connecting with the via Va4 to a connection point connecting with the via Va3.

Figure 5C:
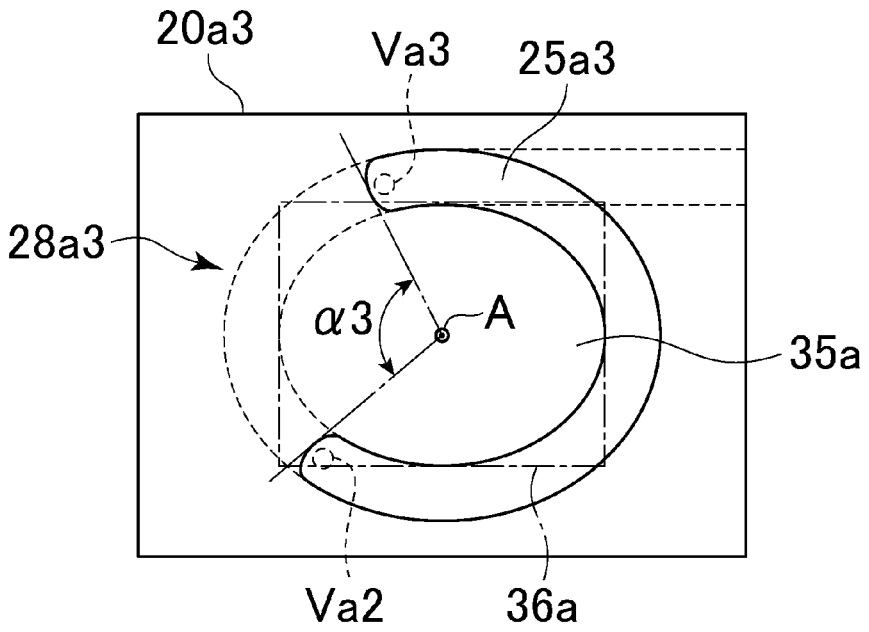
FIG. 5*c* is a plan view showing an insulating film 20*a*3 and a top-side conductive pattern 25*a*3 of FIG. 2.

As shown in FIG. 5*c*, the insulating film 20*a*3 has the conductive pattern 25*a*3 formed thereon. The conductive pattern 25*a*3 is electrically connected to the conductive pattern 25*a*4 via the via Va3. The conductive pattern 25*a*3 extends clockwise around the coil axis A from a connection point connecting with the via Va3 to a connection point connecting with the via Va2.

Figure 5D:
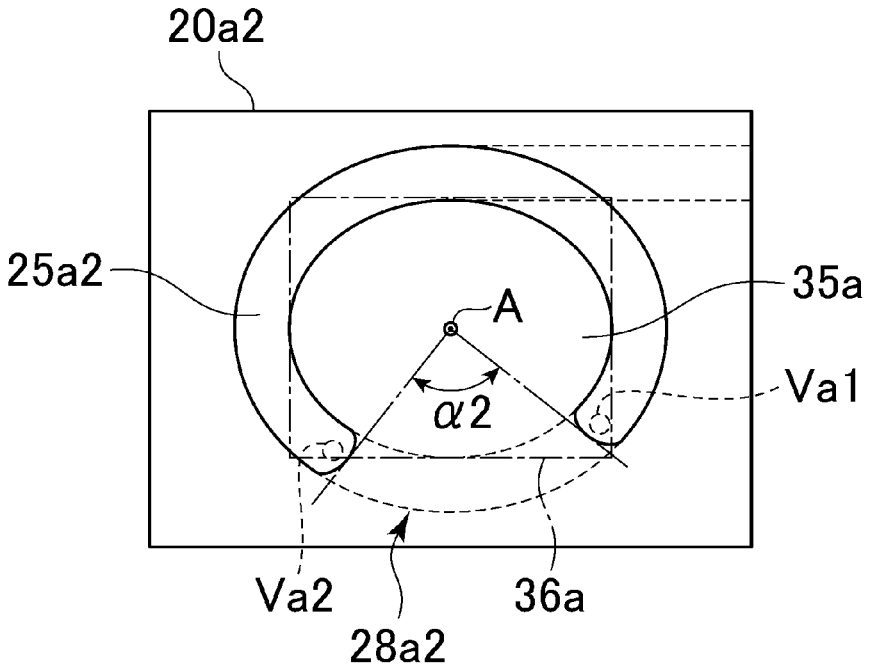
FIG. 5*d* is a plan view showing an insulating film 20*a*2 and a top-side conductive pattern 25*a*2 of FIG. 2.

As shown in FIG. 5*d*, the insulating film 20*a*2 has the conductive pattern 25*a*2 formed thereon. The conductive pattern 25*a*2 is electrically connected to the conductive pattern 25*a*3 via the via Va2. The conductive pattern 25*a*2 extends clockwise around the coil axis A from a connection point connecting with the via Va2 to a connection point connecting with the via Va1.

Figure 5E:
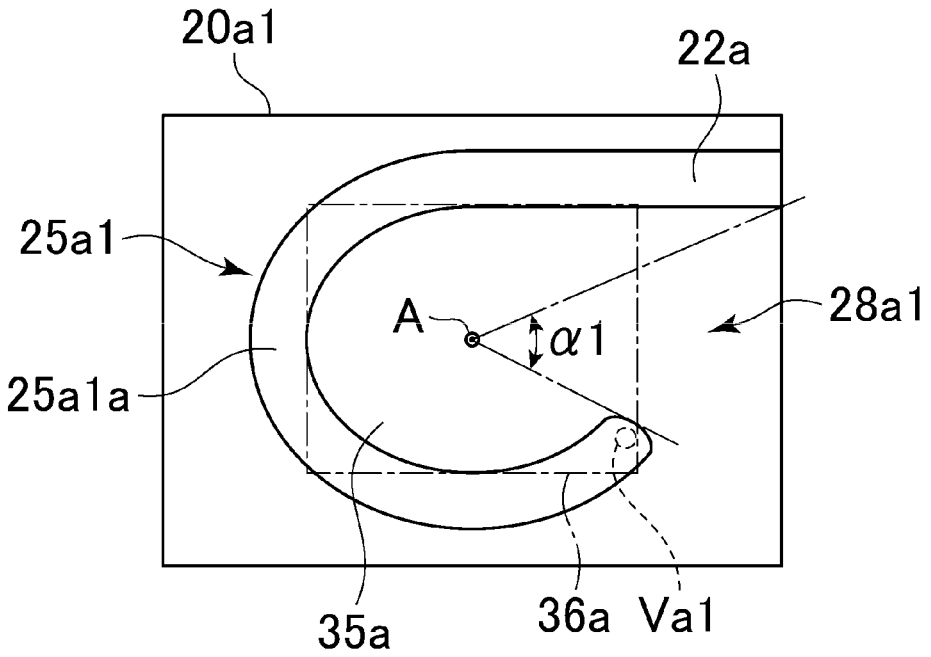
FIG. 5*e* is a plan view showing an insulating film 20*a*1 and a top-side conductive pattern 25*a*1 of FIG. 2.

As shown in FIG. 5*e*, the insulating film 20*a*1 has the conductive pattern 25*a*1 formed thereon. The top-side conductive pattern 25*a*1 includes a circling portion 25*a*1*a* and a lead-out conductor 22*a*. The circling portion 25*a*1*a* is electrically connected to the conductive pattern 25*a*2 via the via Va1. The circling portion 25*a*1*a* extends clockwise around the coil axis A from a connection point connecting with the via Va1. The lead-out conductor 22*a* extends substantially straight from one end of the circling portion 25*a*1*a* opposite to the via Va1 to the external electrode 21*a*.

As described above, each of the top-side conductive patterns 25*a*1 to 25*a*5 is connected to adjacent ones via the top-side vias Va1 to Va4 so as to form the top-side coil conductor 25*a* having a spiral shape. In the embodiment shown, the top-side core 35*a* has a substantially oval outer edge in plan view. The outer edge of the top-side core 35*a* in plan view may have various other shapes in addition to an oval. The outer edge of the top-side core 35*a* in plan view may be, for example, a circle, a rectangle, other polygons, or other various shapes.

FIGS. 5*a* to 5*e* include an imaginary rectangle 36*a* that is circumscribed on the outer edge of the top-side core 35*a* in plan view. This imaginary rectangle may be herein referred to as the circumscribed rectangle 36*a*. The coil axis A may extend through the intersection point of the diagonal lines of the circumscribed rectangle 36*a*.

Figure 6A:
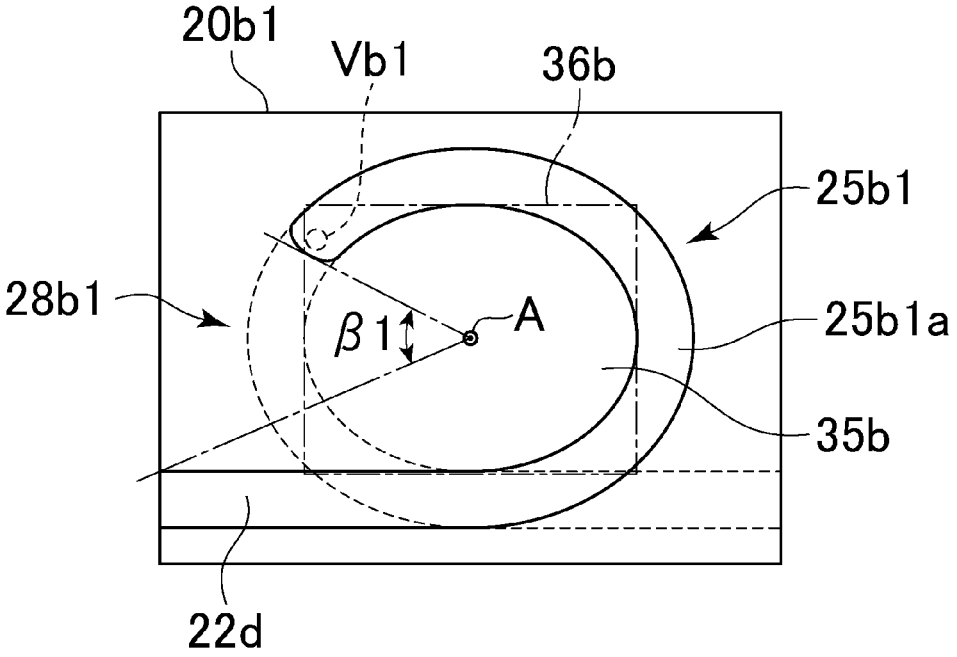
FIG. 6*a* is a plan view showing an insulating film 20*b*1 and a bottom-side conductive pattern 25*b*1 of FIG. 3.

As shown in FIG. 6*a*, the insulating film 20*b*1 has the conductive pattern 25*b*1 formed thereon. The conductive pattern 25*b*1 includes a circling portion 25*b*1*a* and a lead-out conductor 22*d*. The lead-out conductor 22*d* extends substantially straight from one end of the circling portion 25*b*1*a* to the external electrode 21*d*. The circling portion 25*b*1*a* extends counterclockwise around the coil axis A from a connection point connecting with the lead-out conductor 22*d* to a connection point connecting with the via Vb1.

Figure 6B:
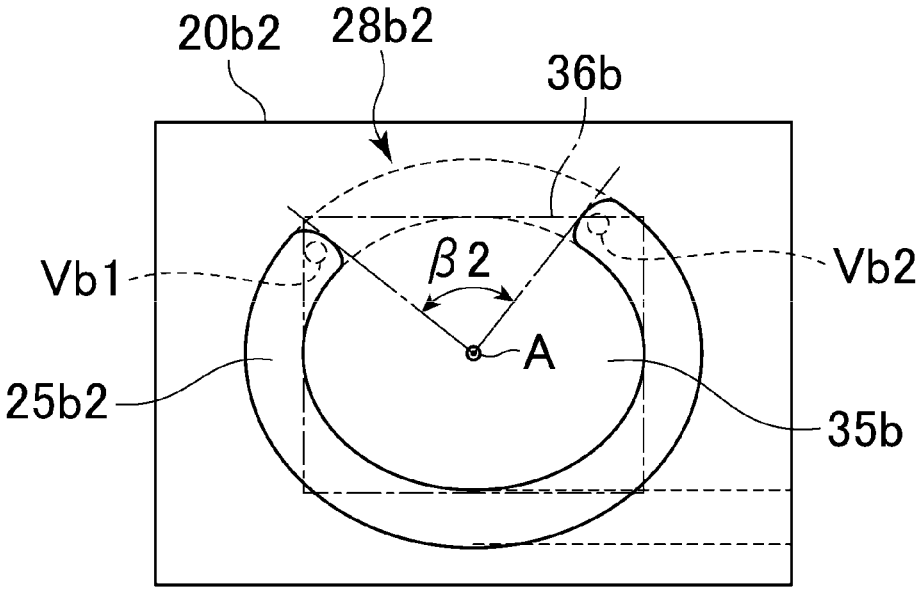
FIG. 6*b* is a plan view showing an insulating film 20*b*2 and a bottom-side conductive pattern 25*b*2 of FIG. 3.

As shown in FIG. 6*b*, the insulating film 20*b*2 has the conductive pattern 25*b*2 formed thereon. The conductive pattern 25*b*2 is electrically connected to the conductive pattern 25*b*1 via the via Vb1. The conductive pattern 25*b*2 extends counterclockwise around the coil axis A from a connection point connecting with the via Vb1 to a connection point connecting with the via Vb2.

Figure 6C:
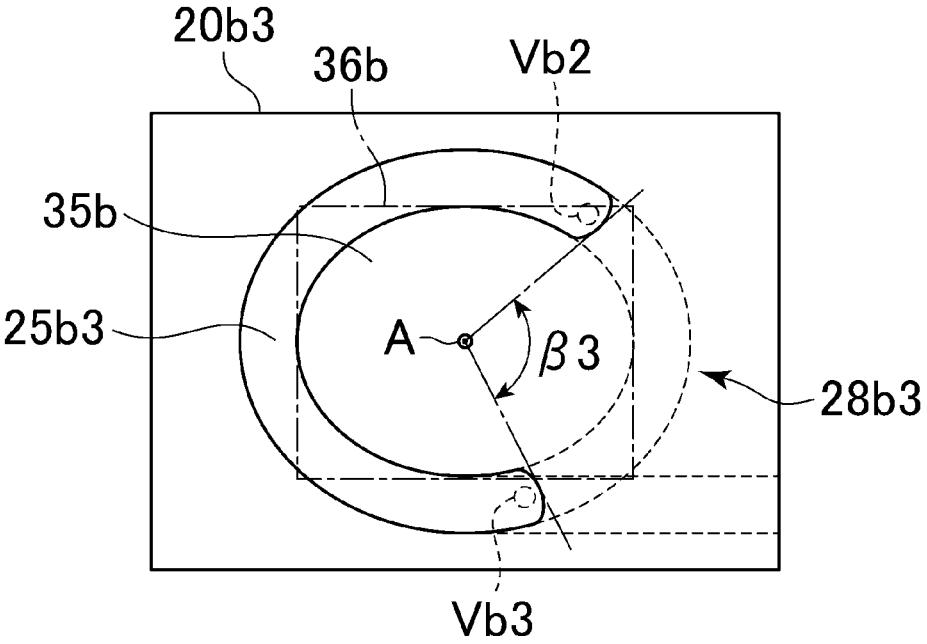
FIG. 6*c* is a plan view showing an insulating film 20*b*3 and a bottom-side conductive pattern 25*b*3 of FIG. 3.

As shown in FIG. 6*c*, the insulating film 20*b*3 has the conductive pattern 25*b*3 formed thereon. The conductive pattern 25*b*3 is electrically connected to the conductive pattern 25*b*2 via the via Vb2. The conductive pattern 25*b*3 extends counterclockwise around the coil axis A from a connection point connecting with the via Vb2 to a connection point connecting with the via Vb3.

Figure 6D:
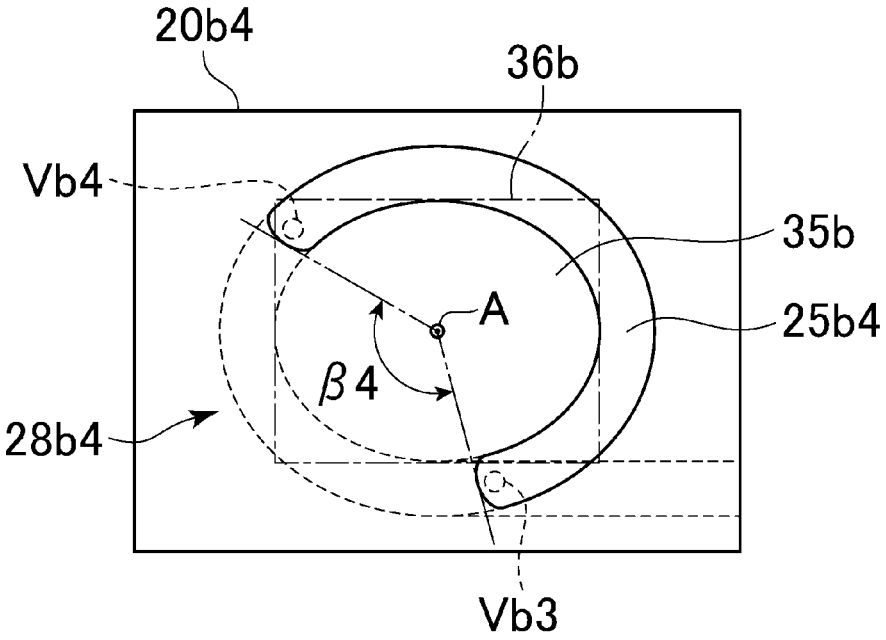
FIG. 6*d* is a plan view showing an insulating film 20*b*4 and a bottom-side conductive pattern 25*b*4 of FIG. 3.

As shown in FIG. 6*d*, the insulating film 20*b*4 has the conductive pattern 25*b*4 formed thereon. The conductive pattern 25*b*4 is electrically connected to the conductive pattern 25*b*3 via the via Vb3. The conductive pattern 25*b*4 extends counterclockwise around the coil axis A from a connection point connecting with the via Vb3 to a connection point connecting with the via Vb4.

Figure 6E:
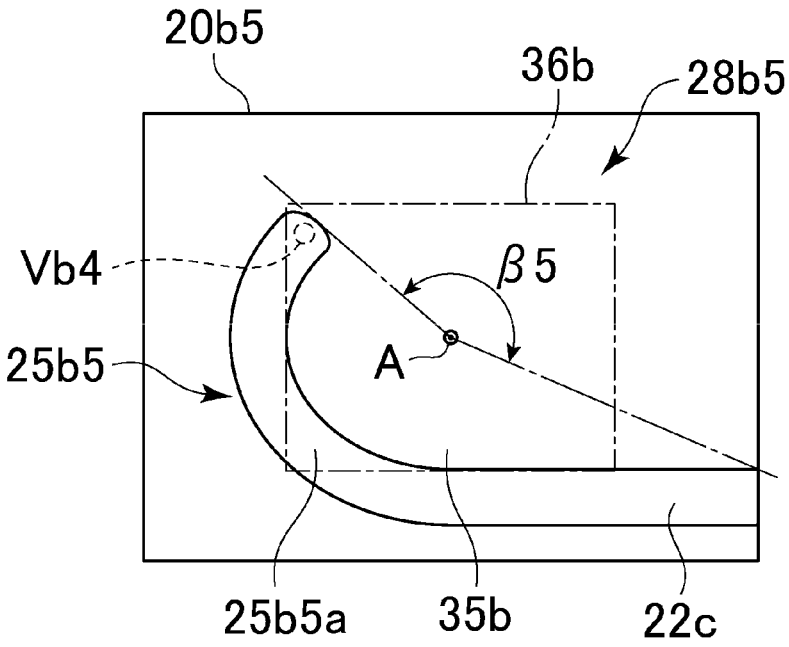
FIG. 6*e* is a plan view showing an insulating film 20*b*5 and a bottom-side conductive pattern 25*b*5 of FIG. 3.

As shown in FIG. 6*e*, the insulating film 20*b*5 has the conductive pattern 25*b*5 formed thereon. The bottom-side conductive pattern 25*b*5 includes a circling portion 25*b*5*a* and a lead-out conductor 22*c*. The circling portion 25*b*5*a* is electrically connected to the conductive pattern 25*b*4 via the via Vb4. The circling portion 25*b*5*a* extends counterclockwise around the coil axis A from a connection point connecting with the via Vb4. The lead-out conductor 22*c* extends substantially straight from one end of the circling portion 25*b*5*a* opposite to the via Vb4 to the external electrode 21*c*.

As described above, each of the bottom-side conductive patterns 25*b*1 to 25*b*5 is connected to adjacent ones via the bottom-side vias Vb1 to Vb4 so as to form the bottom-side coil conductor 25*b* having a spiral shape. The region of the coil layer 20*b* inside the bottom-side coil conductor 25*b* may be referred to as the bottom-side core 35*b*. In the embodiment shown, the bottom-side core 35*b* has a substantially oval outer edge in plan view. The outer edge of the bottom-side core 35*b* in plan view may have various other shapes in addition to an oval. The outer edge of the bottom-side core 35*b* in plan view may be, for example, a circle, a rectangle, other polygons, or other various shapes.

FIGS. 6*a* to 6*e* include an imaginary rectangle 36*b* that is circumscribed on the outer edge of the bottom-side core 35*b* in plan view. This imaginary rectangle may be herein referred to as the circumscribed rectangle 36*b*. The circumscribed rectangle 36*b* may have the same shape as the circumscribed rectangle 36*a* and may be positioned to align with the circumscribed rectangle 36*a* in plan view. In this case, the coil axis A also extends through the intersection point of the diagonal lines of the circumscribed rectangle 36*b*.

The above-described shapes and the arrangements of the main body 10, the top-side conductive patterns 25*a*1 to 25*a*5, the bottom-side conductive patterns 25*b*1 to 25*b*5, the lead-out conductors 22*a* to 22*d*, and the external electrodes 21*a* to 21*d* are mere examples, and various modifications to these elements can be applied to the present invention. For example, it is also possible that the external electrodes 21*a* to 21*d* are all provided on the bottom surface 10*b* of the main body 10. In this case, the lead-out conductors 22*a* to 22*d* are not formed on the insulating films but formed as via conductors extending through the insulating films. Thus, it is possible that the top-side conductive pattern 25*a*5 does not include the lead-out conductor 22*b* and is constituted only by the circling portion 25*a*5*a*. Likewise, it is possible that the top-side conductive pattern 25*a*1 does not include the lead-out conductor 22*a* and is constituted only by the circling portion 25*a*1*a*, the bottom-side conductive pattern 25*b*1 does not include the lead-out conductor 22*d* and is constituted only by the circling portion 25*b*1*a*, and the bottom-side conductive pattern 25*b*5 does not include the lead-out conductor 22*c* and is constituted only by the circling portion 25*b*5*a*. The top-side conductive patterns, the bottom-side conductive patterns, and the lead-out conductors that are applicable to the present invention are not limited to those illustrated in this specification or the attached drawings.

As shown, for each of the top-side conductive patterns 25*a*1 to 25*a*5, an open region having no conductive pattern is present between the opposite ends of the top-side conductive pattern in the circumferential direction around the coil axis A. As shown in FIG. 5*a* for example, in the top-side body 11*a*, an open region 28*a*5 free of the top-side conductive pattern 25*a*5 is present between the opposite ends of the top-side conductive pattern 25*a*5 in the circumferential direction around the coil axis A. The open region 28*a*5 extends over the central angle α5 contained between the two lines connecting between the coil axis A and the opposite ends of the conductive pattern 25*a*5. In plan view (that is, as viewed from the direction of the coil axis A), the open region 28*a*5 may be defined by the two lines connecting between the coil axis A and the opposite ends of the conductive pattern 25*a*5 and the imaginary line 36*a*. The conductive pattern 25*a*5 extends around the coil axis A so as not to overlap the open region 28*a*5. That is, the conductive pattern 25*a*5 extends over the central angle (360°−α5) that does not overlap the open region 28*a*5.

As will be described below, an open region can be set in the same manner for each of the top-side conductive patterns 25*a*2 to 25*a*5. As shown in FIG. 5*b* for example, in the top-side body 11*a*, an open region 28*a*4 free of the top-side conductive pattern 25*a*4 is present between the opposite ends of the top-side conductive pattern 25*a*4 in the circumferential direction around the coil axis A. The open region 28*a*4 extends over the central angle α4 contained between the two lines connecting between the coil axis A and the opposite ends of the conductive pattern 25*a*4. In plan view, the open region 28*a*4 may be defined by the two lines connecting between the coil axis A and the opposite ends of the conductive pattern 25*a*4 and the imaginary line 36*a*. The conductive pattern 25*a*4 extends around the coil axis A so as not to overlap the open region 28*a*4. That is, the conductive pattern 25*a*4 extends over the central angle (360°−α4) that does not overlap the open region 28*a*4.

As shown in FIG. 5*c*, in the top-side body 11*a*, an open region 28*a*3 free of the top-side conductive pattern 25*a*3 is present between the opposite ends of the top-side conductive pattern 25*a*3 in the circumferential direction around the coil axis A. The open region 28*a*3 extends over the central angle α3 contained between the two lines connecting between the coil axis A and the opposite ends of the conductive pattern 25*a*3. In plan view, the open region 28*a*3 may be defined by the two lines connecting between the coil axis A and the opposite ends of the conductive pattern 25*a*3 and the imaginary line 36*a*. The conductive pattern 25*a*3 extends around the coil axis A so as not to overlap the open region 28*a*3. That is, the conductive pattern 25*a*3 extends over the central angle (360°−α3) that does not overlap the open region 28*a*3.

As shown in FIG. 5*d*, in the top-side body 11*a*, an open region 28*a*2 free of the top-side conductive pattern 25*a*2 is present between the opposite ends of the top-side conductive pattern 25*a*2 in the circumferential direction around the coil axis A. The open region 28*a*2 extends over the central angle α2 contained between the two lines connecting between the coil axis A and the opposite ends of the conductive pattern 25*a*2. In plan view, the open region 28*a*2 may be defined by the two lines connecting between the coil axis A and the opposite ends of the conductive pattern 25*a*2 and the imaginary line 36*a*. The conductive pattern 25*a*2 extends around the coil axis A so as not to overlap the open region 28*a*2. That is, the conductive pattern 25*a*2 extends over the central angle (360°−α2) that does not overlap the open region 28*a*2.

As shown in FIG. 5*e*, in the top-side body 11*a*, an open region 28*a*1 free of the top-side conductive pattern 25*a*1 is present between the opposite ends of the top-side conductive pattern 25*a*1 in the circumferential direction around the coil axis A. The open region 28*a*1 extends over the central angle α1 contained between the two lines connecting between the coil axis A and the opposite ends of the conductive pattern 25*a*1. In plan view, the open region 28*a*1 may be defined by the two lines connecting between the coil axis A and the opposite ends of the conductive pattern 25*a*1 and the imaginary line 36*a*. The conductive pattern 25*a*1 extends around the coil axis A so as not to overlap the open region 28*a*1. That is, the conductive pattern 25*a*1 extends over the central angle (360°−α1) that does not overlap the open region 28*a*1.

In the same manner as with the top-side conductive patterns 25*a*1 to 25*a*5, an open region can be set for each of the bottom-side conductive patterns 25*b*1 to 25*b*5. More specifically, as shown in FIG. 6*a*, in the bottom-side body 11*b*, an open region 28*b*1 free of the bottom-side conductive pattern 25*b*1 is present between the opposite ends of the bottom-side conductive pattern 25*b*1 in the circumferential direction around the coil axis A. The open region 28*b*1 extends over the central angle 131 contained between the two lines connecting between the coil axis A and the opposite ends of the conductive pattern 25*b*1. In plan view (that is, as viewed from the direction of the coil axis A), the open region 28*b*1 may be defined by the two lines connecting between the coil axis A and the opposite ends of the conductive pattern 25*b*1 and the imaginary line 36*b*. The conductive pattern 25*b*1 extends around the coil axis A so as not to overlap the open region 28*b*1. That is, the conductive pattern 25*b*1 extends over the central angle (360°−β1) that does not overlap the open region 28*b*1.

As shown in FIG. 6*b*, in the bottom-side body 11*b*, an open region 28*b*2 free of the bottom-side conductive pattern 25*b*2 is present between the opposite ends of the bottom-side conductive pattern 25*b*2 in the circumferential direction around the coil axis A. The open region 28*b*2 extends over the central angle β2 contained between the two lines connecting between the coil axis A and the opposite ends of the conductive pattern 25*b*2. In plan view (that is, as viewed from the direction of the coil axis A), the open region 28*b*2 may be defined by the two lines connecting between the coil axis A and the opposite ends of the conductive pattern 25*b*2 and the imaginary line 36*b*. The conductive pattern 25*b*2 extends around the coil axis A so as not to overlap the open region 28*b*2. That is, the conductive pattern 25*b*2 extends over the central angle (360°−β2) that does not overlap the open region 28*b*2.

As shown in FIG. 6*c*, in the bottom-side body 11*b*, an open region 28*b*3 free of the bottom-side conductive pattern 25*b*3 is present between the opposite ends of the bottom-side conductive pattern 25*b*3 in the circumferential direction around the coil axis A. The open region 28*b*3 extends over the central angle 83 contained between the two lines connecting between the coil axis A and the opposite ends of the conductive pattern 25*b*3. In plan view (that is, as viewed from the direction of the coil axis A), the open region 28*b*3 may be defined by the two lines connecting between the coil axis A and the opposite ends of the conductive pattern 25*b*3 and the imaginary line 36*b*. The conductive pattern 25*b*3 extends around the coil axis A so as not to overlap the open region 28*b*3. That is, the conductive pattern 25*b*3 extends over the central angle (360°−β3) that does not overlap the open region 28*b*3.

As shown in FIG. 6*d*, in the bottom-side body 11*b*, an open region 28*b*4 free of the bottom-side conductive pattern 25*b*4 is present between the opposite ends of the bottom-side conductive pattern 25*b*4 in the circumferential direction around the coil axis A. The open region 28*b*4 extends over the central angle β4 contained between the two lines connecting between the coil axis A and the opposite ends of the conductive pattern 25*b*4. In plan view (that is, as viewed from the direction of the coil axis A), the open region 28*b*4 may be defined by the two lines connecting between the coil axis A and the opposite ends of the conductive pattern 25*b*4 and the imaginary line 36*b*. The conductive pattern 25*b*4 extends around the coil axis A so as not to overlap the open region 28*b*4. That is, the conductive pattern 25*b*4 extends over the central angle (360°−β4) that does not overlap the open region 28*b*4.

As shown in FIG. 6*e*, in the bottom-side body 11*b*, an open region 28*b*5 free of the bottom-side conductive pattern 25*b*5 is present between the opposite ends of the bottom-side conductive pattern 25*b*5 in the circumferential direction around the coil axis A. The open region 28*b*5 extends over the central angle β5 contained between the two lines connecting between the coil axis A and the opposite ends of the conductive pattern 25*b*5. In plan view (that is, as viewed from the direction of the coil axis A), the open region 28*b*5 may be defined by the two lines connecting between the coil axis A and the opposite ends of the conductive pattern 25*b*5 and the imaginary line 36*b*. The conductive pattern 25*b*5 extends around the coil axis A so as not to overlap the open region 28*b*5. That is, the conductive pattern 25*b*5 extends over the central angle (360°−β5) that does not overlap the open region 28*b*5.

In one embodiment of the present invention, the top-side coil conductor 25*a* is configured such that, of the plurality of top-side conductive patterns constituting the top-side coil conductor 25*a*, one that is closest to the first region 30 of the main body 10 is wound for a larger number of turns than the average of the numbers of turns of the plurality of top-side conductive patterns. In the embodiment shown, the top-side coil conductor 25*a* is constituted by the top-side conductive patterns 25*a*1 to 25*a*5, and of these top-side conductive patterns, the top-side conductive pattern 25*a*1 is closest to the first region 30. Therefore, the number of turns of the top-side conductive pattern 25*a*1 is larger than the average of the numbers of turns of the top-side conductive patterns 25*a*1 to 25*a*5 constituting the top-side coil conductor 25*a*.

In this specification, the number of turns of a conductive pattern wound around the coil axis refers to the proportion of the region spanned by the conductive pattern in the circumference around the coil axis. The number of turns of a conductive pattern can be given using the central angle of the region spanned by the conductive pattern. For example, in the embodiment shown, the conductive pattern 25*a*1 extends over the central angle (360°−α1) in the circumferential direction around the coil axis A. Therefore, the conductive pattern 25*a*1 is wound for (360−α1)/360 (=1−α1/360) turns in the circumferential direction around the coil axis A. In other words, the number of turns of the conductive pattern 25*a*1 is 1−αa1/360. When the value of a1 is positive, the number of turns of the conductive pattern 25*a*1 is less than one. The value of a1 may also be zero or negative. For example, in the embodiment shown in FIG. 5*e*, the circling portion 25*a*1 further extending around the coil axis A makes the value of al negative. Likewise, the number of turns of the conductive pattern 25*a*2 is 1−α2/360, the number of turns of the conductive pattern 25*a*3 is 1−α3/360, the number of turns of the conductive pattern 25*a*4 is 1−α4/360, and the number of turns of the conductive pattern 25*a*5 is 1−α5/360. The values of α2 to α5 may be positive, zero, or negative. The average of the numbers of turns of the top-side conductive patterns 25*a*1 to 25*a*5 is 1−((α1+α2+α3+α4+α5)/5)/360.

Therefore, when the number of turns of the top-side conductive pattern 25*a*1 is larger than the average of the numbers of turns of the top-side conductive patterns 25*a*1 to 25*a*5 constituting the top-side coil conductor 25*a*, the following expression is true.

$$\alpha 1<(\alpha 2+\alpha 3+\alpha 4+\alpha 5)/4 \quad \text{(Expression 2)}$$

Expression 1 can be rearranged into Expression 2 below.

$$\alpha 1<(\alpha 2+\alpha 3+\alpha 4+\alpha 5)/4 \quad \text{(Expression 2)}$$

As is understood from Expression 2, in one embodiment of the present invention, the central angles α1 to α5 of the open regions 28*a*1 to 28*a*5 on the insulating films 20*a*1 to 20*a*5 are compared as follows: the central angle α1 of the open region 28*a*1 on the insulating film 20*a*1 that is closest to the first region 30 is smaller than the average of the central angles α2 to α5(that is, (α2+α3+α4+α5)/4) of the open regions 28*a*2 to 28*a*5 on the other insulating films 20*a*2 to 20*a*5. Thus, since the open region 28*a*1 is small, a large magnetic resistance is obtained in the region between the top-side coil conductor 25*a* and the bottom-side coil conductor 25*b* (the region including the first region 30 and the open region 28*a*1). As a result, less magnetic flux leaks by passing between the top-side coil conductor 25*a* and the bottom-side coil conductor 25*b*.

In one embodiment of the present invention, of the plurality of top-side conductive patterns constituting the top-side coil conductor 25*a*, the top-side conductive pattern 25*a*1 which is closest to the first region 30 is wound for a larger number of turns than the top-side conductive pattern 25*a*2 which is more distant from the first region 30 than the top-side conductive pattern 25*a*1. In this case, the following expression is true.

$$1-\alpha 1/360>1-\alpha 2/360 \quad \text{(Expression 3)}$$

The left side of Expression 3 represents the number of turns of the top-side conductive pattern 25*a*1, and the right side of Expression 3 represents the number of turns of the top-side conductive pattern 25*a*2. Expression 3 can be rearranged into Expression 4 below.

$$\alpha 1<\alpha 2 \quad \text{(Expression 4)}$$

According to this embodiment, as is obvious from Expression 4, the open region 28*a*1 is small, and therefore, a large magnetic resistance is obtained in the region between the top-side coil conductor 25*a* and the bottom-side coil conductor 25*b* (the region including the first region 30 and the open region 28*a*1). As a result, less magnetic flux leaks by passing between the top-side coil conductor 25*a* and the bottom-side coil conductor 25*b*.

The top-side conductive pattern 25*a*2 may be wound for a larger number of turns than the top-side conductive pattern 25*a*3 which is more distant from the first region 30 than the top-side conductive pattern 25*a*2. The top-side conductive pattern 25*a*3 may be wound for a larger number of turns than the top-side conductive pattern 25*a*4 which is more distant from the first region 30 than the top-side conductive pattern 25*a*3. The top-side conductive pattern 25*a*4 may be wound for a larger number of turns than the top-side conductive pattern 25*a*5 which is more distant from the first region 30 than the top-side conductive pattern 25*a*4. Thus, the top-side coil conductor 25*a* may be configured such that the numbers of turns of the top-side conductive patterns constituting the top-side coil conductor 25*a* are smaller in the direction away from the first region 30.

In the embodiment shown, the number of turns of the top-side conductive pattern 25*a*1 is about 5/6 (the central angle $\alpha 1$ is about 60°), the number of turns of the top-side conductive pattern 25*a*2 is about 3/4 (the central angle $\alpha 2$ is about 90°), the number of turns of the top-side conductive pattern 25*a*3 is about 2/3 (the central angle $\alpha 3$ is about 120°, the number of turns of the top-side conductive pattern 25*a*4 is about 7/12 (the central angle $\alpha 4$ is about 150°, and the number of turns of the top-side conductive pattern 25*a*5 is about 1/2 (the central angle $\alpha 5$ is about 180°).

Next, a description will be given of the numbers of turns of the bottom-side conductive patterns constituting the bottom-side coil conductor 25*b*. In one embodiment of the present invention, the bottom-side coil conductor 25*b* is configured such that, of the plurality of bottom-side conductive patterns constituting the bottom-side coil conductor 25*b*, one that is closest to the first region 30 of the main body 10 is wound for a larger number of turns than the average of the numbers of turns of the plurality of bottom-side conductive patterns. In the embodiment shown, the bottom-side coil conductor 25*b* is constituted by the bottom-side conductive patterns 25*b*1 to 25*b*5, and of these bottom-side conductive patterns, the bottom-side conductive pattern 25*b*1 is closest to the first region 30. Therefore, the number of turns of the bottom-side conductive pattern 25*b*1 is larger than the average of the numbers of turns of the bottom-side conductive patterns 25*b*1 to 25*b*5 constituting the bottom-side coil conductor 25*b*.

Next, a description will be given of the numbers of turns of the bottom-side conductive patterns 25*b*1 to 25*b*5. The numbers of turns of these conductive patterns can be given using the central angles of the regions spanned by these conductive patterns. The conductive pattern 25*b*1 extends over the central angle (360°−$\beta 1$) in the circumferential direction around the coil axis A. Therefore, the conductive pattern 25*b*1 is wound for (360−$\beta 1$)/360 (=1−$\beta 1$/360) turns in the circumferential direction around the coil axis A. In other words, the number of turns of the conductive pattern 25*b*1 is 1−$\beta 1$/360. Likewise, the number of turns of the conductive pattern 25*b*2 is 1−$\beta 2$/360, the number of turns of the conductive pattern 25*b*3 is 1−$\beta 3$/360, the number of turns of the conductive pattern 25*b*4 is 1−$\beta 4$/360, and the number of turns of the conductive pattern 25*b*5 is 1−$\beta 5$/360. The average of the numbers of turns of the bottom-side conductive patterns 25*b*1 to 25*b*5 is 1−(($\beta 1$+$\beta 2$+$\beta 3$+$\beta 4$+$\beta 5$)/5)/360. When the value of $\beta 1$ is positive, the number of turns of the conductive pattern 25*b*1 is less than one. The values of $\beta 1$ to $\beta 5$ may be positive, zero, or negative.

Therefore, the number of turns of the bottom-side conductive pattern 25*b*1 is larger than the average of the numbers of turns of the bottom-side conductive patterns 25*b*1 to 25*b*5 constituting the bottom-side coil conductor 25*b*, the following expression is true.

$$(1-\beta 1/360)>1-((\beta 1+\beta 2+\beta 3+\beta 4+\beta 5)/5)/360 \quad \text{(Expression 5)}$$

Expression 5 can be rearranged into Expression 6 below.

$$\beta 1<(\beta 2+\beta 3+\beta 4+\beta 5)/4 \quad \text{(Expression 6)}$$

As is understood from Expression 6, in one embodiment of the present invention, the central angles $\beta 1$ to $\beta 5$ of the open regions 28*b*1 to 28*b*5 on the insulating films 20*b*1 to 20*b*5 are compared as follows: the central angle $\beta 1$ of the open region 28*b*1 on the insulating film 20*b*1 that is closest to the first region 30 is smaller than the average of the central angles $\beta 2$ to $\beta 5$ (that is, ($\beta 2$+$\beta 3$+$\beta 4$+$\beta 5$)/4) of the open regions 28*b*2 to 28*b*5 on the other insulating films 20*b*2 to 20*b*5. Thus, since the open region 28*b*1 is small, a large magnetic resistance is obtained in the region between the top-side coil conductor 25*a* and the bottom-side coil conductor 25*b* (the region including the first region 30 and the open region 28*b*1). As a result, less magnetic flux leaks by passing between the top-side coil conductor 25*a* and the bottom-side coil conductor 25*b*.

In one embodiment of the present invention, of the plurality of bottom-side conductive patterns constituting the bottom-side coil conductor 25*b*, the bottom-side conductive pattern 25*b*1 which is closest to the first region 30 is wound for a larger number of turns than the bottom-side conductive pattern 25*b*2 which is more distant from the first region 30 than the bottom-side conductive pattern 25*b*1. In this case, the following expression is true.

$$1-\beta 1/360>1-\beta 2/360 \quad \text{(Expression 7)}$$

The left side of Expression 7 represents the number of turns of the bottom-side conductive pattern 25*b*1, and the right side of Expression 7 represents the number of turns of the bottom-side conductive pattern 25*b*2. Expression 7 can be rearranged into Expression 8 below.

$$\beta 1<\beta 2 \quad \text{(Expression 8)}$$

According to this embodiment, as is obvious from Expression 8, the open region 28*b*1 is small, and therefore, a large magnetic resistance is obtained in the region between the top-side coil conductor 25*a* and the bottom-side coil conductor 25*b* (the region including the first region 30 and the open region 28*b*1). As a result, less magnetic flux leaks by passing between the top-side coil conductor 25*a* and the bottom-side coil conductor 25*b*.

The bottom-side conductive pattern 25*b*2 may be wound for a larger number of turns than the bottom-side conductive pattern 25*b*3 which is more distant from the first region 30 than the bottom-side conductive pattern 25*b*2.

The bottom-side conductive pattern 25*b*3 may be wound for a larger number of turns than the bottom-side conductive pattern 25*b*4 which is more distant from the first region 30 than the bottom-side conductive pattern 25*b*3. The bottom-side conductive pattern 25*b*4 may be wound for a larger number of turns than the bottom-side conductive pattern 25*b*5 which is more distant from the first region 30 than the bottom-side conductive pattern 25*b*4. Thus, the bottom-side coil conductor 25*b* may be configured such that the numbers of turns of the bottom-side conductive patterns constituting the bottom-side coil conductor 25*b* are smaller in the direction away from the first region 30.

In the embodiment shown, the number of turns of the bottom-side conductive pattern 25*b*1 is about 5/6 (the central angle β1 is about 60°), the number of turns of the bottom-side conductive pattern 25*b*2 is about 3/4 (the central angle β2 is about 90°), the number of turns of the bottom-side conductive pattern 25*b*3 is about 2/3 (the central angle β3 is about 120°), the number of turns of the bottom-side conductive pattern 25*b*4 is about 7/12 (the central angle β4 is about 150°), and the number of turns of the bottom-side conductive pattern 25*b*5 is about 1/2 (the central angle β5 is about 180°).

In one embodiment of the present invention, the open region 28*a*2 is positioned so as not to overlap the open region 28*a*1 as viewed from the direction of the coil axis A (in plan view). As shown in FIGS. 5*d* and 5*e*, in the embodiment shown, the open region 28*a*1 and the open region 28*a*2 are positioned so as not to overlap each other as viewed from the direction of the coil axis A. According to this embodiment, it is possible to prevent the reduction of the magnetic resistance due to overlap of the open region 28*a*1 and the open region 28*a*2. As a result, the leakage flux passing between the top-side coil conductor 25*a* and the bottom-side coil conductor 25*b* can be suppressed more effectively. The open region 28*a*3 may be positioned so as not to overlap the open region 28*a*2 as viewed from the direction of the coil axis A (in plan view). The open region 28*a*4 may be positioned so as not to overlap the open region 28*a*3 as viewed from the direction of the coil axis A (in plan view). The open region 28*a*5 may be positioned so as not to overlap the open region 28*a*4 as viewed from the direction of the coil axis A (in plan view).

In one embodiment of the present invention, the open region 28*b*2 is positioned so as not to overlap the open region 28*b*1 as viewed from the direction of the coil axis A (in plan view). As shown in FIGS. 6*a* and 6*b*, in the embodiment shown, the open region 28*b*1 and the open region 28*b*2 are positioned so as not to overlap each other as viewed from the direction of the coil axis A. According to this embodiment, it is possible to prevent the reduction of the magnetic resistance due to overlap of the open region 28*b*1 and the open region 28*b*2. As a result, the leakage flux passing between the top-side coil conductor 25*a* and the bottom-side coil conductor 25*b* can be suppressed more effectively. The open region 28*b*3 may be positioned so as not to overlap the open region 28*b*2 as viewed from the direction of the coil axis A (in plan view). The open region 28*b*4 may be positioned so as not to overlap the open region 28*b*3 as viewed from the direction of the coil axis A (in plan view). The open region 28*b*5 may be positioned so as not to overlap the open region 28*b*4 as viewed from the direction of the coil axis A (in plan view).

The above embodiments can be combined together as necessary. For example, it is possible that the number of turns of the top-side conductive pattern 25*a*1 is larger than the average of the numbers of turns of the top-side conductive patterns 25*a*1 to 25*a*5 constituting the top-side coil conductor 25*a*, and the number of turns of the bottom-side conductive pattern 25*b*1 is larger than the average of the numbers of turns of the bottom-side conductive patterns 25*b*1 to 25*b*5 constituting the bottom-side coil conductor 25*b*, and it is also possible that this condition of the numbers of turns is true only for one of the top-side coil conductor 25*a* and the bottom-side coil conductor 25*b*. Further, it is possible that the number of turns of the top-side conductive pattern 25*a*1 is larger than the average of the numbers of turns of the top-side conductive patterns 25*a*1 to 25*a*5 constituting the top-side coil conductor 25*a*, and the number of turns of the top-side conductive pattern 25*a*1 is larger than the number of turns of the top-side conductive patterns 25*a*2, and it is also possible that only one of these conditions related to the numbers of turns is true. It is possible that the number of turns of the bottom-side conductive pattern 25*b*1 is larger than the average of the numbers of turns of the bottom-side conductive patterns 25*b*1 to 25*b*5 constituting the bottom-side coil conductor 25*b*, and the number of turns of the bottom-side conductive pattern 25*b*1 is larger than the number of turns of the bottom-side conductive patterns 25*b*2, and it is also possible that only one of these conditions related to the numbers of turns is true.

Next, a description is given of an example of a production method of the coil component 1. The coil component 1 can be produced by, for example, a lamination process. A production method of the coil component 1 using a lamination process will be hereinafter described.

The first step is to produce green sheets to be used as the insulating films 20*a*1 to 20*a*5, the insulating films 20*b*1 to 20*b*5, the insulating films constituting the top-side first cover layer 18*a*, the insulating films constituting the bottom-side first cover layer 18*b*, the insulating films constituting the top-side second cover layer 19*a*, and the insulating films constituting the bottom-side second cover layer 19*b*. These green sheets are made of, for example, a ferrite, a soft magnetic alloy, a resin including filler particles dispersed therein, or other insulating materials. It is hereinafter supposed that the green sheets are made of a soft magnetic alloy. A slurry is prepared by mixing a binder resin and a solvent with soft magnetic metal particles made of a Fe—Si-based alloy, a Fe—Ni-based alloy, a Fe—Co-based alloy, a Fe—Cr—Si-based alloy, a Fe—Si—Al-based alloy, a Fe—Si—B—Cr-based alloy, or any other soft magnetic alloys, and the slurry is applied to the surface of a base film made of plastic. The applied slurry is dried to produce the green sheets.

Next, through-holes are formed at predetermined positions in the green sheets to be used as the insulating films 20*a*2 to 20*a*5 and the green sheets to be used as the insulating films 20*b*1 to 20*b*4, so as to extend through the green sheets in the direction of the axis T.

Next, a conductive paste is applied by screen printing onto the top surfaces of the green sheets to be used as the insulating films 20*a*1 to 20*a*5 and the top surfaces of the green sheets to be used as the insulating films 20*b*1 to 20*b*5, thereby to form conductive patterns on the green sheets. Then, a conductive paste is filled into the through-holes formed in the green sheets. The conductive patterns formed on the green sheets to be used as the insulating films 20*a*1 to 20*a*5 constitute the top-side conductive patterns 25*a*1 to 25*a*5, respectively, and the metal filled in the through-holes forms the top-side vias Va1 to Va4. The conductive patterns formed on the green sheets to be used as the insulating films 20*b*1 to 20*b*5 constitute the bottom-side conductive patterns 25*b*1 to 25*b*5, respectively, and the metal filled in the through-holes forms the bottom-side vias Vb1 to Vb4. It is also possible that the conductive patterns and the vias are formed by various known methods other than screen printing.

Next, the green sheets to be used as the insulating films 20*a*1 to 20*a*5 are stacked together to form a top-side coil laminate. The green sheets to be used as the insulating layers 20*a*1 to 20*a*5 are stacked together such that the top-side conductive patterns 25*a*1 to 25*a*5 formed on these green sheets are each electrically connected to adjacent conductive patterns through the top-side vias Va1 to Va4. Likewise, the green sheets to be used as the insulating films 20*b*1 to 20*b*5 are stacked together to form a bottom-side coil laminate. The green sheets to be used as the insulating layers 20*b*1 to 20*b*5 are stacked together such that the bottom-side conductive patterns 25*b*1 to 25*b*5 formed on these green sheets are each electrically connected to adjacent conductive patterns through the bottom-side vias Vb1 to Vb4.

Next, the green sheets to be used as the top-side first cover layer 18*a* are stacked together to form a top-side first laminate, the green sheets to be used as the top-side second cover layer 19*a* are stacked together to form a top-side second laminate, the green sheets to be used as the bottom-side first cover layer 18*b* are stacked together to form a bottom-side first laminate, and the green sheets to be used as the bottom-side second cover layer 19*b* are stacked together to form a bottom-side second laminate.

Next, the bottom-side second laminate, the bottom-side coil laminate, the bottom-side first laminate, the top-side second laminate, the top-side coil laminate, and the top-side first laminate are stacked together in this order from the negative side to the positive side in the direction of the axis T, and these stacked laminates are bonded together by thermal compression using a pressing machine to produce a body laminate. It is also possible to form the body laminate by sequentially stacking all the prepared green sheets together and bonding the stacked green sheets together by thermal compression, without forming the bottom-side second laminate, the bottom-side coil laminate, the bottom-side first laminate, the top-side second laminate, the top-side coil laminate, and the top-side first laminate.

Next, the body laminate is segmented to a desired size by using a cutter such as a dicing machine or a laser processing machine to produce a chip laminate. Next, the chip laminate is degreased and then heated. The end portions of the chip laminate is subjected to a polishing process such as barrel-polishing, if necessary.

Next, a conductive paste is applied to both end portions of the chip laminate to form the external electrodes 21*a* to 21*d*. At least one of a solder barrier layer and a solder wetting layer may be provided to the external electrodes 21*a* to 21*d*, if necessary. Thus, the coil component 1 is obtained A part of the steps included in the above production method may be omitted as necessary. In the production method of the coil component 1, steps not described explicitly in this specification may be performed as necessary. A part of the steps included in the production method of the coil component 1 may be performed in different order within the purport of the present invention. A part of the steps included in the production method of the coil component 1 may be performed at the same time or in parallel, if possible.

The green sheets to be used as the insulating films may be formed of a ferrite or a resin including filler particles dispersed therein. The coil component 1 may be produced by a known method using the green sheets formed of a ferrite or a resin including filler particles dispersed therein.

It is also possible that the insulating films included in the coil component 1 are constituted by insulating sheets made by temporarily setting a resin having various types of filler particles dispersed therein. Such insulating sheets do not need to be degreased.

It is also possible to produce the coil component 1 by the slurry build method or any other known methods.

The coil component 1, which is formed by the lamination process, is more susceptible to downsizing than conventional assembled coupled inductors.

The dimensions, materials, and arrangements of the constituents described in this specification are not limited to those explicitly described for the embodiments, and the constituents can be modified to have any dimensions, materials, and arrangements within the scope of the present invention. Constituents other than those explicitly described herein can be added to the described embodiments; and part of the constituents described for the embodiments can be omitted.

What is claimed is:

1. A magnetic coupling coil component, comprising:

a main body including a first region, a second region disposed on a top side of the first region, and a third region disposed on a bottom side of the first region;

a top-side coil conductor provided in the second region of the main body and wound around a coil axis extending in a top-bottom direction; and a bottom-side coil conductor provided in the third region of the main body and wound around the coil axis, wherein the top-side coil conductor includes a plurality of top-side conductive patterns, and the plurality of top-side conductive patterns include a first top-side conductive pattern which is positioned closest to the first region among the plurality of top-side conductive patterns, and a number of turns of the first top-side conductive pattern is larger than an average of numbers of turns of the plurality of top-side conductive patterns.

2. The magnetic coupling coil component of claim 1, wherein the plurality of top-side conductive patterns include a second top-side conductive pattern which is more distant from the first region than the first top-side conductive pattern, and the number of turns of the first top-side conductive pattern is larger than that of the second top-side conductive pattern.

3. The magnetic coupling coil component of claim 2, wherein the plurality of top-side conductive patterns include a third top-side conductive pattern which is more distant from the first region than the second top-side conductive pattern, and the number of turns of the second top-side conductive pattern is larger than that of the third top-side conductive pattern.

4. The magnetic coupling coil component of claim 1, wherein the first top-side conductive pattern include a circling portion and a lead-out conductor, the circling portion extending in a circumferential direction around the coil axis, the lead-out conductor connecting between one end of the circling portion and an external electrode.

5. The magnetic coupling coil component of claim 1, wherein the plurality of top-side conductive patterns include a second top-side conductive pattern which is more distant from the first region than the first top-side conductive pattern, and the main body includes a first top-side open region and a second top-side open region, the first top-side open region extending between opposite ends of the first top-side conductive pattern, the second top-side open region extending between opposite ends of the second top-side conductive pattern, and the second top-side open region does not overlap the first top-side open region as viewed from the direction of the coil axis.

6. The magnetic coupling coil component of claim 1, wherein the bottom-side coil conductor includes a plurality of bottom-side conductive patterns, and the plurality of bottom-side conductive patterns include a first bottom-side conductive pattern which is positioned closest to the first region among the plurality of bottom-side conductive patterns, and a number of turns of the first bottom-side conductive pattern is larger than an average of numbers of turns of the plurality of bottom-side conductive patterns.

7. The magnetic coupling coil component of claim 6, wherein the plurality of bottom-side conductive patterns include a second bottom-side conductive pattern which is more distant from the first region than the first bottom-side conductive pattern, and the number of turns of the first bottom-side conductive pattern is larger than that of the second bottom-side conductive pattern.

8. The magnetic coupling coil component of claim 7, wherein the plurality of bottom-side conductive patterns include a third bottom-side conductive pattern which is more distant from the first region than the second bottom-side conductive pattern, and the number of turns of the second bottom-side conductive pattern is larger than that of the third bottom-side conductive pattern.

9. The magnetic coupling coil component of claim 6, wherein the first bottom-side conductive pattern include a circling portion and a lead-out conductor, the circling portion extending in a circumferential direction around the coil axis, the lead-out conductor connecting between one end of the circling portion and an external electrode.

10. The magnetic coupling coil component of claim 6, wherein the plurality of bottom-side conductive patterns include a second bottom-side conductive pattern which is more distant from the first region than the first bottom-side conductive pattern, and the main body includes a first bottom-side open region and a second bottom-side open region, the first bottom-side open region extending between opposite ends of the first bottom-side conductive pattern, the second bottom-side open region extending between opposite ends of the second bottom-side conductive pattern, and the second bottom-side open region does not overlap the first bottom-side open region as viewed from the direction of the coil axis.

11. A magnetic coupling coil component, comprising:

a main body including a first region, a second region disposed on a top side of the first region, and a third region disposed on a bottom side of the first region;

a top-side coil conductor provided in the second region of the main body and wound around a coil axis extending in a top-bottom direction; and a bottom-side coil conductor provided in the third region of the main body and wound around the coil axis, wherein the bottom-side coil conductor includes a plurality of bottom-side conductive patterns, and the plurality of bottom-side conductive patterns include a first bottom-side conductive pattern which is positioned closest to the first region among the plurality of bottom-side conductive patterns, and a number of turns of the first bottom-side conductive pattern is larger than an average of numbers of turns of the plurality of bottom-side conductive patterns.

12. The magnetic coupling coil component of claim 11, wherein the plurality of bottom-side conductive patterns include a second bottom-side conductive pattern which is more distant from the first region than the first bottom-side conductive pattern, and the number of turns of the first bottom-side conductive pattern is larger than that of the second bottom-side conductive pattern.

13. The magnetic coupling coil component of claim 12, wherein the plurality of bottom-side conductive patterns include a third bottom-side conductive pattern which is more distant from the first region than the second bottom-side conductive pattern, and the number of turns of the second bottom-side conductive pattern is larger than that of the third bottom-side conductive pattern.

14. The magnetic coupling coil component of claim 11, wherein the first bottom-side conductive pattern include a circling portion and a lead-out conductor, the circling portion extending in a circumferential direction around the coil axis, the lead-out conductor connecting between one end of the circling portion and an external electrode.

15. The magnetic coupling coil component of claim 11, wherein the plurality of bottom-side conductive patterns include a second bottom-side conductive pattern which is more distant from the first region than the first bottom-side conductive pattern, and the main body includes a first bottom-side open region and a second bottom-side open region, the first bottom-side open region extending between opposite ends of the first bottom-side conductive pattern, the second bottom-side open region extending between opposite ends of the second bottom-side conductive pattern, and the second bottom-side open region does not overlap the first bottom-side open region as viewed from the direction of the coil axis.

* * * * *